US006412869B1

(12) United States Patent
Pearce

(10) Patent No.: US 6,412,869 B1
(45) Date of Patent: Jul. 2, 2002

(54) NESTABLE SYNCHROTILT CHAIR

(75) Inventor: Peter Jon Pearce, Woodland Hills, CA (US)

(73) Assignee: Steelcase Development Corporation, Caledonia, MI (US)

( * ) Notice: Subject to any disclaimer, the term of this patent is extended or adjusted under 35 U.S.C. 154(b) by 0 days.

(21) Appl. No.: 09/321,275

(22) Filed: May 27, 1999

(51) Int. Cl.[7] ..... A47C 3/00; A47C 3/04

(52) U.S. Cl. ..... 297/294; 297/295; 297/300.2; 297/452.65; 297/300.4; 297/239

(58) Field of Search ..... 297/285, 294, 297/295, 297, 298, 452.65, 452.54, 291, 292, 293, 239, 300.1, 300.2, 300.3, 300.4

(56) References Cited

U.S. PATENT DOCUMENTS

| | | | | |
|---|---|---|---|---|
| 2,146,932 A | | 2/1939 | Boman | |
| 3,087,755 A | | 4/1963 | Boman | |
| 3,767,261 A | | 10/1973 | Rowland | |
| D239,345 S | | 3/1976 | Keller | |
| 3,944,280 A | | 3/1976 | Keeler | |
| 3,982,785 A | | 9/1976 | Ambasz | |
| 4,240,663 A | | 12/1980 | Locher | |
| 4,366,980 A | | 1/1983 | Rowland | |
| 4,368,917 A | | 1/1983 | Urai | |
| 4,639,012 A | | 1/1987 | Jensen | |
| 4,660,887 A | | 4/1987 | Fleming et al. | |
| 4,938,530 A | | 7/1990 | Snyder et al. | |
| 4,962,964 A | | 10/1990 | Snodgrass | |
| 5,154,485 A | | 10/1992 | Fleishman | |
| 5,887,945 A | * | 3/1999 | Sedlack | 297/296 X |
| 6,056,361 A | * | 5/2000 | Cvek | 297/285 X |

OTHER PUBLICATIONS

Discloses a webpage www.theknollshop.com/sbd/knollshop/home.nsf, showing a "Toledo" chair manufactured by Knoll Int'l. and made public prior to the filing date of the present application.

* cited by examiner

*Primary Examiner*—Anthony D. Barfield
(74) *Attorney, Agent, or Firm*—Price, Heneveld, Cooper, DeWitt & Litton

(57) ABSTRACT

A synchrotilt chair includes a base, a back, a seat, and a pair of parallel links pivoted to a rear of the base and to a bottom of the back to form a four-bar linkage arrangement. A spring arrangement includes leaf springs that extend between each link and the base to bias the link and in turn the back and seat toward an upright position, with the back and seat pivoting with a synchronous motion upon recline of the back. The base, the back, the seat, and the links are shaped to receive identical chairs along a stacking direction to form a densely nested stacked arrangement for compact storage. The base has a distinctive horizontal U-shaped mid-frame structure defining a plurality of corners, and further having up legs and down legs extending upwardly and downwardly, respectively, from each of the corners, with the pair of links attached to the two rearmost ones of the up legs. The base (and also separately the back and the seat structures) are injection molded as single pieces from a reinforced polymeric material in a manner that provides a lightweight, yet surprisingly rigid and sturdy construction. Armrests are pivoted to the back and have a shape configured to allow nested stacking while also providing excellent comfort, durability, and style.

52 Claims, 19 Drawing Sheets

NESTABLE SYNCHROTILT CHAIR

BACKGROUND OF THE PRESENT INVENTION

The present invention relates to nestable chairs, and also relates to chairs having a reclineable back and a seat that moves with a synchronous motion upon recline of the back. The present invention further relates to chairs with components made from a few polymeric moldings that are easily assembled.

Modern consumers demand comfort and style in their chairs, but also demand cost-effective solutions given the highly competitive furniture industry. Further, the chairs must be durable and rugged, yet preferably should be mechanically simple, easily assembled, and use low-cost components. Still further, many consumers want a modernistic appearance and one that takes advantage of modern materials, part-forming processes, and assembly techniques. Often consumers need chairs that are mobile and that can be stored in dense arrangements that minimize the storage space required. A problem is that these requirements create conflicting design criteria. For example, low-cost chairs tend to be less comfortable and less stylized. Chairs that are more comfortable, such as synchrotilt chairs, have more expensive components and greater assembly costs, are not stackable nor nestable for dense storage, and are usually too heavy to be. lifted and/or stacked for storage.

Accordingly, a chair having the aforementioned advantages and features, and solving the aforementioned problems is desired.

SUMMARY OF THE INVENTION

In one aspect of the present invention, a chair includes a base, a seat pivoted to the base, and a back pivoted to the seat. The chair also includes an upwardly extending link pivoted to a rear of the base at a lower pivot and to a bottom of the back at an upper pivot. The base, the seat, the back, and the link define a linkage arrangement where, when the back is reclined at a first angular rate, the seat rotates at a second angular rate in synchronous motion with the back. The chair further includes an energy device operably connected to the linkage arrangement that biases the back toward an upright position.

In another aspect of the present invention, a chair includes a base, a seat pivoted to the base, and a back pivoted to the seat at a back pivot for movement between upright and reclined positions. The chair also includes a link pivoted to the base at a first pivot and to the back at a second pivot to form an interconnected linkage arrangement. The back pivot is located above the first and second pivots. The chair further includes an energy device located at and operably connected to the link and at least one of the first and second pivots, and that is configured to bias the back toward the upright position.

In another aspect of the present invention, a chair includes a base having a horizontal U-shaped structure defining front and rear corners, and further having a down leg extending downwardly from each of the front and rear corners and an up leg extending upwardly from each of the front corners. The chair includes a link extending from each of the rear corners, and includes a seat and a back operably supported on the up legs and connected to the links for movement between upright and reclined positions.

In another aspect of the present invention, an article of furniture includes first and second furniture components pivoted together at a joint defining an axis of rotation. The first and second furniture components include first and second recesses, respectively, extending from the joint. The article of furniture further includes a leaf spring having first and second ends that extend into the first and second recesses and having a section offset from the axis of rotation. The leaf spring. biases the first and second furniture components in a first direction.

In another aspect of the present invention, a chair includes a molded one-piece base, a molded one-piece seat pivoted to the base, and a reclineable back pivoted to the seat. The back is operably mounted on the one-piece base so that it is movable between upright and reclined positions. The chair further includes a spring integrally attached to at least two of the base, the back, and the seat and biases the back toward the upright position.

In another aspect of the present invention, a chair includes a chair frame having a horizontally extending mid-frame section and having up legs and down legs extending from corners of the mid-frame section, with the down legs being adapted to stably support the chair frame on a floor surface. The chair further includes a back and a seat operably connected to the up legs of the mid-frame and configured to move with a synchronous motion upon recline of the back.

In yet another aspect of the present invention, a chair includes a base including down legs configured to stably engage a floor surface and including sections forming a rail support, and a seat and a reclineable back operably connected to the base for synchronous movement during recline of the back. The base defines an opening in one direction and has a shape configured to mateably nestingly engage a corresponding opening on an identical chair parallel the one direction. The seat and the back are configured to mateably nestingly engage corresponding structure on an identical chair with the rail support being adapted to support a weight of the identical chair, whereby the chair can be stored in a dense stacked arrangement with other identical chairs.

In yet another aspect of the present invention, a system includes a plurality of nested synchrotilt chairs, each successive chair including a base supporting a portion of the weight of an adjacent one of the chairs.

In yet another aspect of the present invention, the present chair design has an inventive ornamental appearance.

These and other features, objects, and advantages of the present invention will become apparent to a person of ordinary skill upon reading the following description and claims together with reference to the accompanying drawings.

DETAILED DESCRIPTION OF PREFERRED EMBODIMENT

Figure 6A:
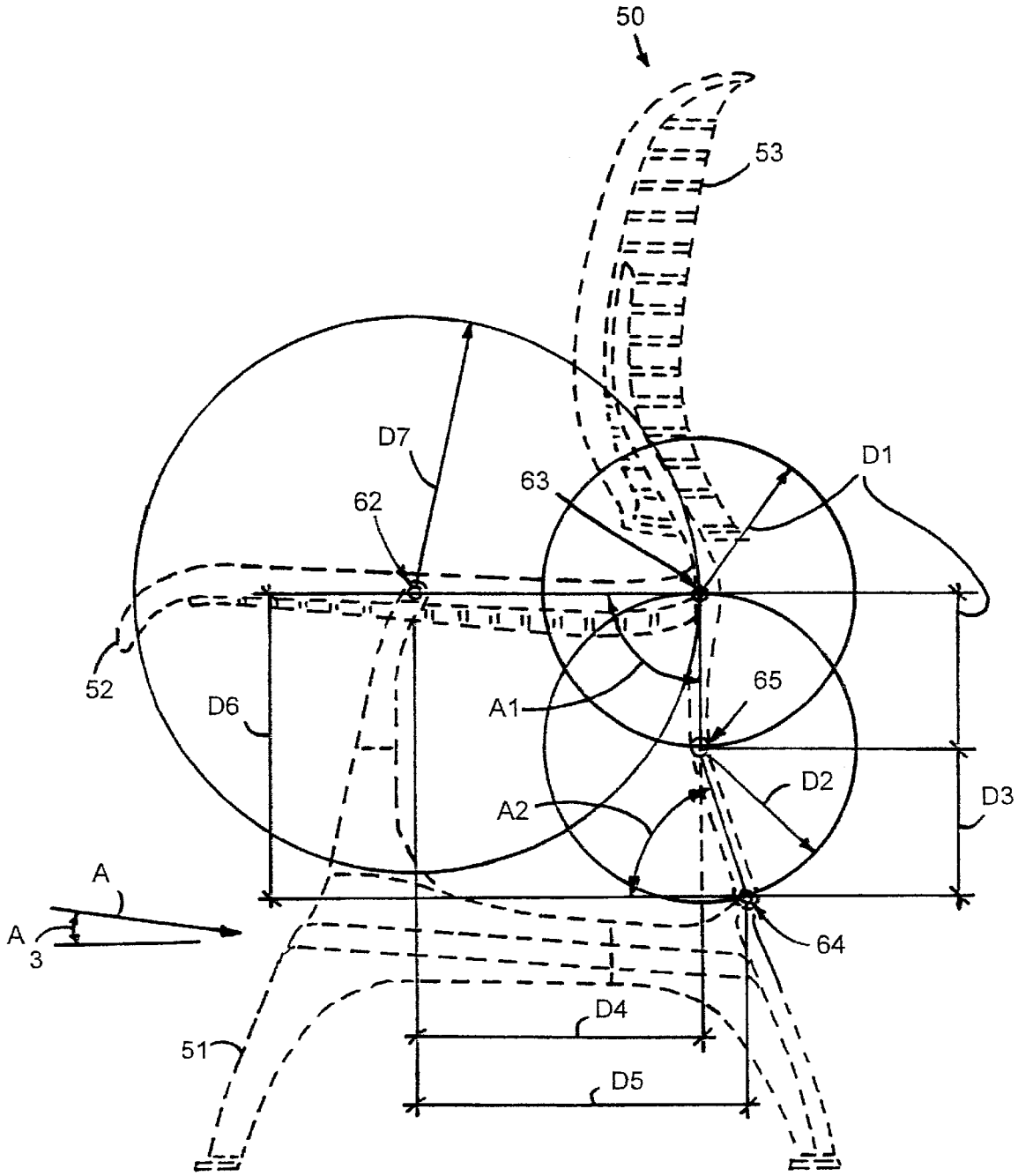
FIG. 6A is a side view similar to FIG. 6, but showing dimensional relationships.
Figure 11:
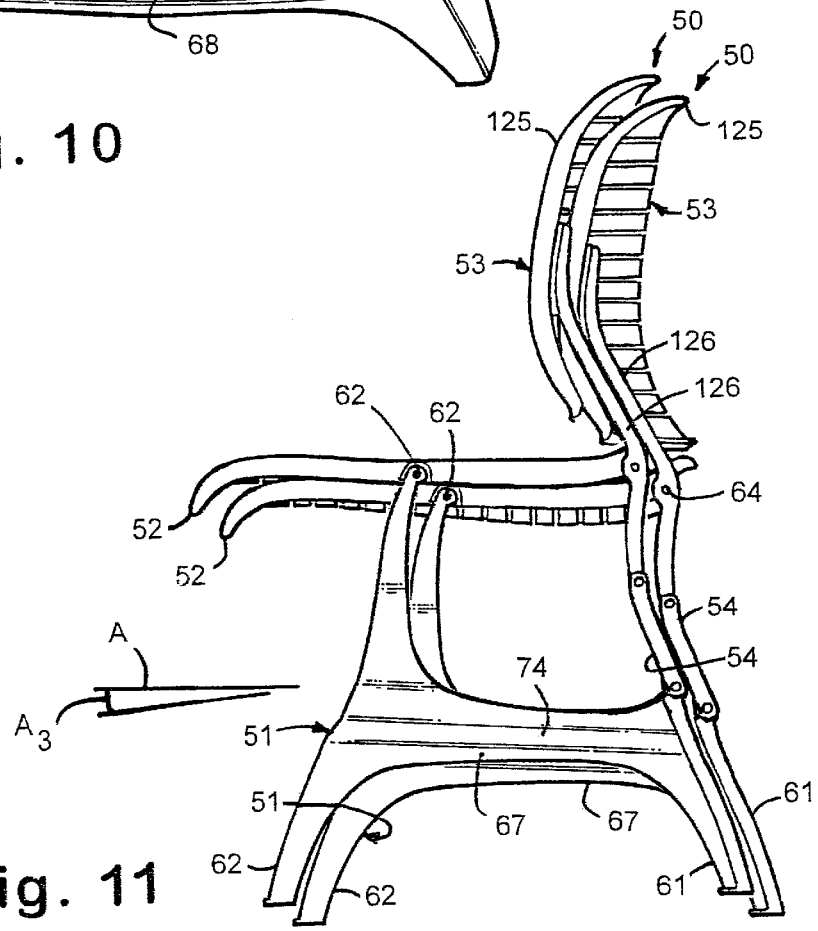
FIG. 11 is a side view of a pair of the chairs shown in FIG. 1 nested together in a stacked arrangment.
Figures 12, 13, 14, 15:
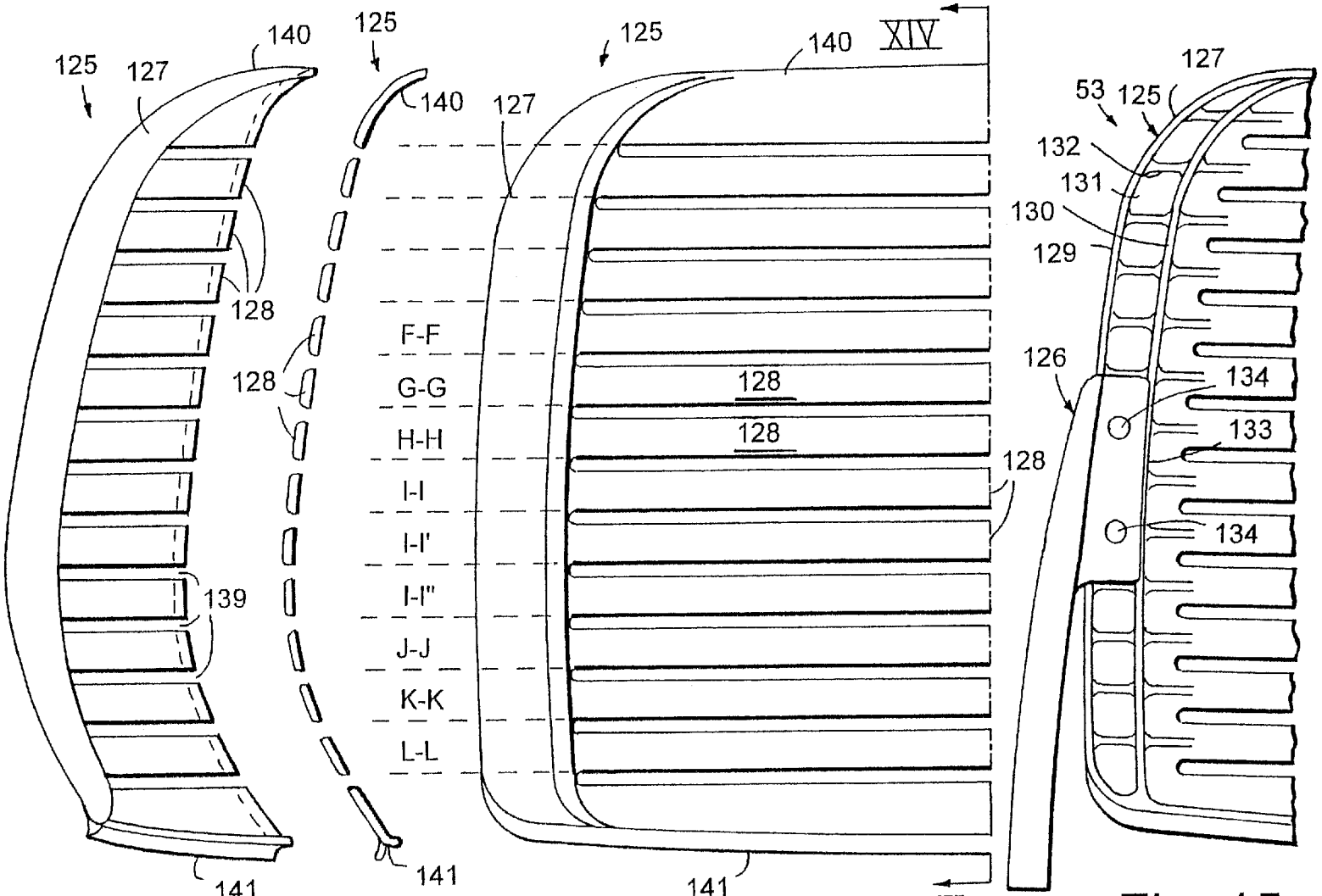
FIG. 12 is a side view of the back shell of the back shown in FIG. 1.
FIG. 13 is a front view of half of the back shown in FIG. 12.
FIG. 14 is a cross-sectional view taken along the line XIV—XIV in FIG. 13.
FIG. 15 a fragmentary rear view of the back shown in FIG. 1, including the fixed lever attached to the back shell.

A chair 50 (FIG. 1) embodying the present invention includes a base 51, a seat 52 pivoted to the base 51 at a seat-to-base first pivot 62, and a back 53 pivoted to the seat 52 at a back-to-seat second pivot 63. A pair of upwardly extending semi-parallel links 54 is pivoted to a rear of the base 51 at a link-to-base third pivot 64 and to a bottom of the back 53 at a link-to-back fourth pivot 65 to form a four-bar linkage arrangement with the seat 52 and the back 53. A spring arrangement includes leaf springs 55 that extend past third pivot 64 between each link 54 and the base 51 to bias the links 54 and in turn bias the back 53 and seat 52 toward an upright position. The back 53 and seat 52 pivot with a synchronous motion upon recline of the back 53. Advantageously, the base 51, the back 53, the seat 52, and the links 54 are shaped to nest against identical chairs along a stacking direction "A" (FIG. 11) to form a densely stacked arrangement for compact storage. The "stacking" direction "A" extends at a slight angle A3 to horizontal, as shown in FIGS. 6A and 11, but of course its orientation will change if the chairs 20 are stored on a wheeled cart that provides a different storage position. Further, the components 51–54 are lightweight and one-piece or "few-piece" constructions that provide low cost and that facilitate quick assembly.

Figures 7, 7A, 7B, 7C, 7D, 7E, 7F, 7G, 7H, 7I, 7J, 7K, 7L, 7M:
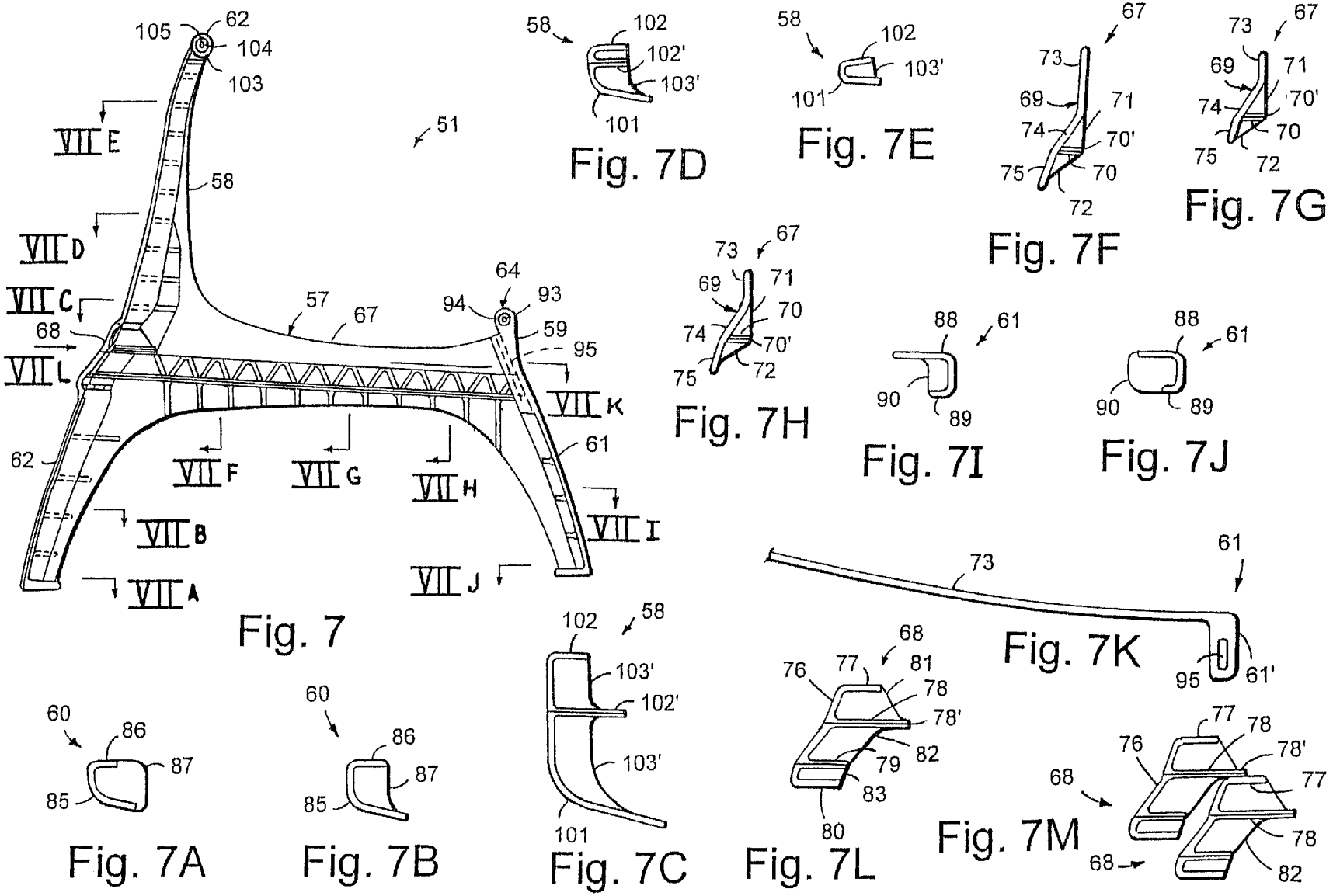
FIG. 7 is a cross-sectional view taken along lines VII—VII in FIG. 3.
FIGS. 7A–7L are cross-sectional views taken along lines 7A–7L, respectively, in FIG. 7.
FIG. 7M is a cross-sectional view similar to FIG. 7L, but showing the relationship of transverse front sections of the bases in a pair of the chairs nested together.

The illustrated base 51 (FIG. 1) is a one-piece injection-molded part molded from reinforced polymeric material, e.g., a glass reinforced polymer. It is specifically contemplated that the base can be manufactured from other materials, such as tubular metal, aluminum castings, carbon fiber, and the like. The illustrated base 51 has a total weight of only about three pounds, yet it is surprisingly rigid and of sturdy construction. The base 51 has a distinctive rearwardly facing, horizontal U-shaped mid-frame structure 57 (FIG. 7) defining a plurality of comers, and further has pairs of front and rear up legs 58 and 59 and pairs of front and rear down legs 60 and 61 extending upwardly and downwardly, respectively, from each of the comers. The down legs 60 and 61 are configured to stably engage a floor surface. The front up legs 58 are configured to stably pivotally support the seat 52, and the rear up legs 59 are configured to stably pivotally support the bottom of the links 54.

More specifically, the mid-frame structure 57 (FIG. 7) includes a pair of side beam sections 67 and a front beam section 68 forming the U-shape of the mid-frame structure 57. The side beam sections 67 (FIGS. 7F–7H) have cross sections that mirror each other. The beam sections 67 include an approximately vertical longitudinal wall 69 and a longitudinal/horizontal stiffening rib 70. Angled and vertical webs 71 and 72, respectively, stabilize the wall 69 and the rib 70 to form a rigid beam having a high strength-to-weight ratio. The thickness of wall 69, rib 70, and webs 71 and 72 are all about equal to facilitate the molding process and to minimize distortion upon cooling of the base 51 during molding. The vertical/longitudinal wall 69 includes an approximately vertical top portion 73, a significantly angled mid portion 74, and a slightly angled bottom portion 75. The side beam sections 67 are non-parallel, but instead are angled laterally/outwardly toward their rear end to form an open structure or "throat" adapted to receive an identical chair base 51 in a dense stacked arrangement for storing the chairs. The angled mid portion 74 includes an outer surface angled to form a track or support rail that slidably engages a mating portion on horizontal rib 70 and web 72 on a second chair 50 being nested against a first chair 50 (see FIG. 11) to support at least a portion of a weight of the second chair.

The front beam section 68 (FIG. 7L) includes a longitudinal/vertical wall 76 and several. longitudinal/horizontal stiffening ribs 77–80 that extend inwardly from the wall 76. Vertical webs 81 and 83 and angled webs 82 stabilize the wall 76 and the ribs 77–80 to form a rigid beam having a high strength-to-weight ratio. The thickness of wall 76, ribs 77–80, and webs 81–83 are all about equal to facilitate the molding process and to minimize distortion upon cooling of the base 51. The second highest rib 78 is elongated, and includes a rear section 78' that extends approximately parallel the highest rib 77. This arrangement and the shape of wall 76 cause the rear section 78' of the second highest rib 78 of a first chair 50 to rest on the highest rib 77 of a nested second chair 50 (see FIG. 7M).

Front down legs 60 (FIGS. 7A and 7B) each have a C-shaped cross section with an L-shaped outer side wall 85, an inner stiffening rib 86, and webs 87 for stabilizing the wall 85 and the rib 86. A bottom one of the webs 87 forms a platform for stably engaging a floor surface. Rear down legs 61 (FIGS. 7I and 7J) each have a shape similar to front down legs 60. Specifically, the front down legs 60 each include a C-shaped cross section with an outer L-shaped side wall 88, an inner stiffening rib 89, and webs 90 for stabilizing the wall 88 and the rib 89. A bottom one of the webs 90 forms a platform for stably engaging a floor surface.

Figure 28:
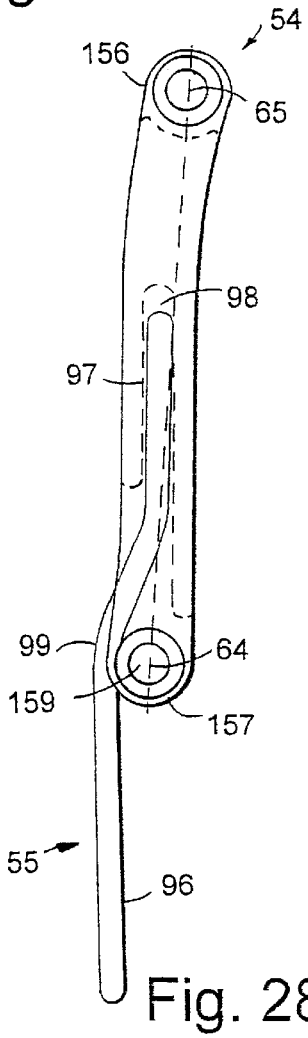
FIG. 28 is a side view of an assembly of the link shown in FIG. 23 and the spring shown in FIG. 26.

Atop each rear down leg 61 (FIG. 7) is an enlarged top section 59 (also called a "rear up leg" herein) having a hole 93 for receiving a pivot pin 94 to form the bottom link-to-base pivot 64. Further, a pocket or recess 95 extends longitudinally downwardly into a top section 61' of the rear down legs 61 at a location spaced slightly forward of the hole 93. The pocket 95 is configured to closely receive a lower half 96 (FIG. 28) of the spring 55. The spring 55 further includes an upper half 97 that is adapted to engage a pocket 98 in the link 54, and an intermediate section 99 that connects the upper and lower halves 96 and 97 in an offset relationship so that the halves 96 and 97 are oriented to engage the respective pockets 95 and 98. Further, the offset intermediate section 99 orients the halves 96 and 97 in a non-linear arrangement so that the spring 97 will clear pivot 94.

Figure 8:
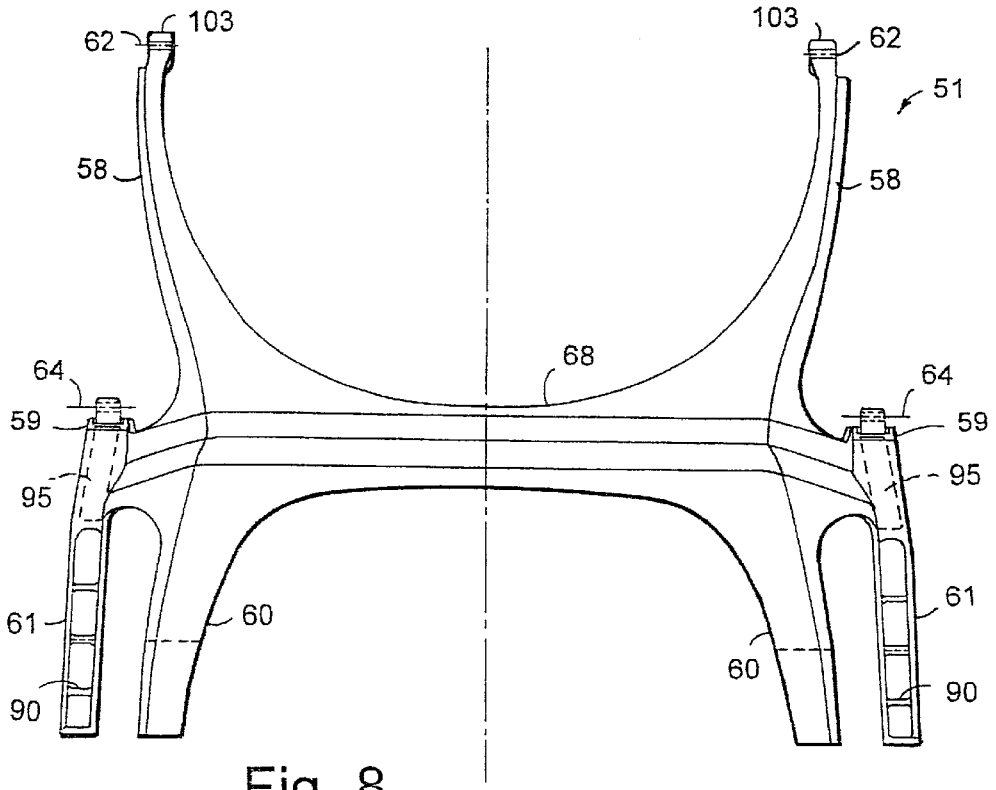
FIGS. 8–10 are front, rear, and top views of the base shown in FIG. 7.
Figure 9:
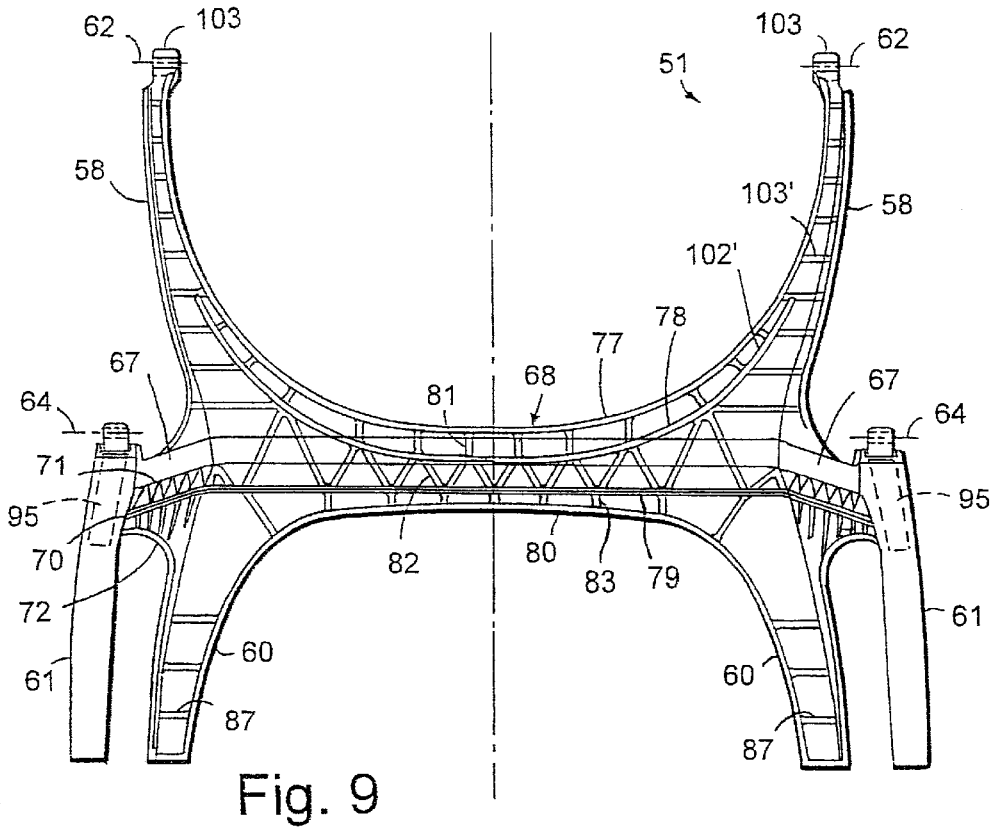
Figure 10:
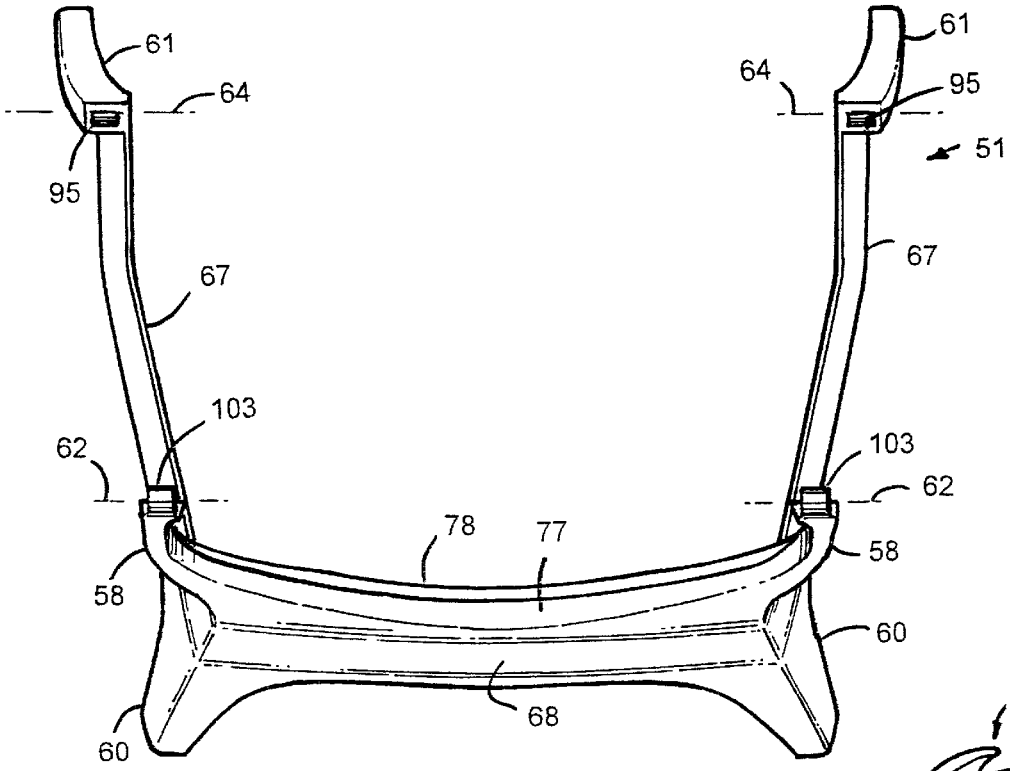

Front up legs 58 (FIGS. 7C–7E) each have a C-shaped cross section with an L-shaped outer side wall 101, inner stiffening ribs 102 and 102', and webs 103' for stabilizing the wall 101 and the ribs 102 and 102'. An enlargement 103 (FIG. 7) on a top end of the front up legs 58 includes a hole 104 for receiving a pivot pin 105 to form the seat-to-base pivot 62. The front up legs 58 are angled forwardly and outwardly to mate with the seat 52 (FIG. 8).

Figure 2:
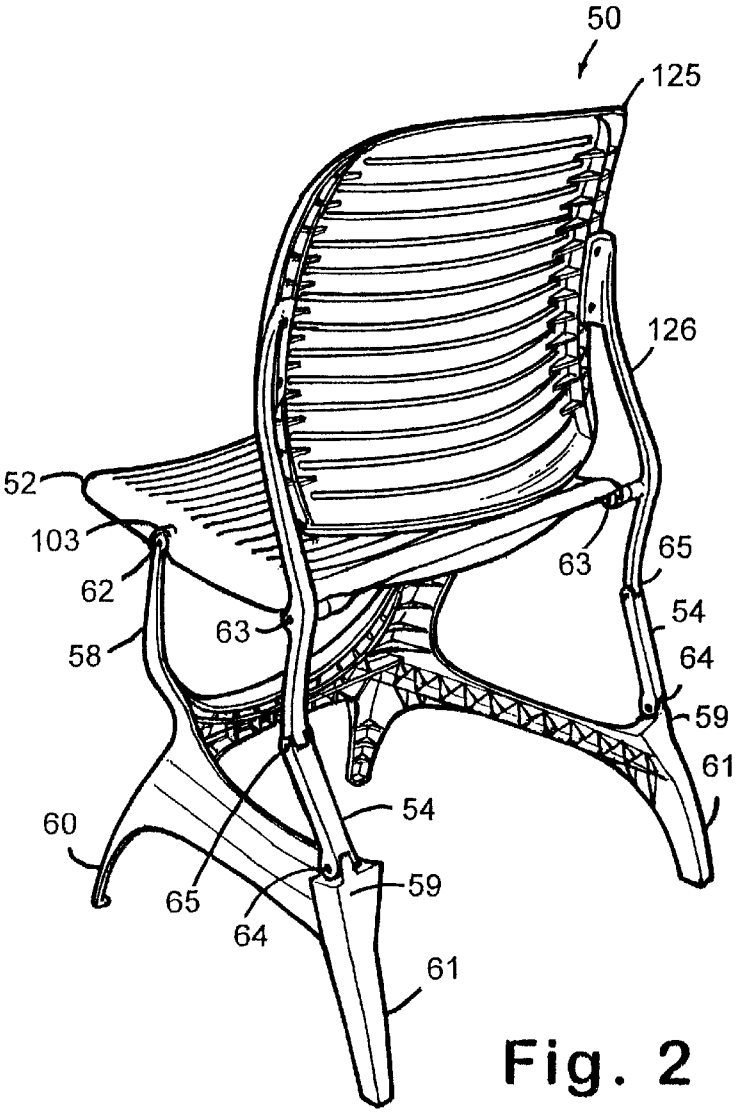
FIGS. 1 and 2 are front and rear perspective views, respectively, of a chair embodying the present invention.
Figure 1:
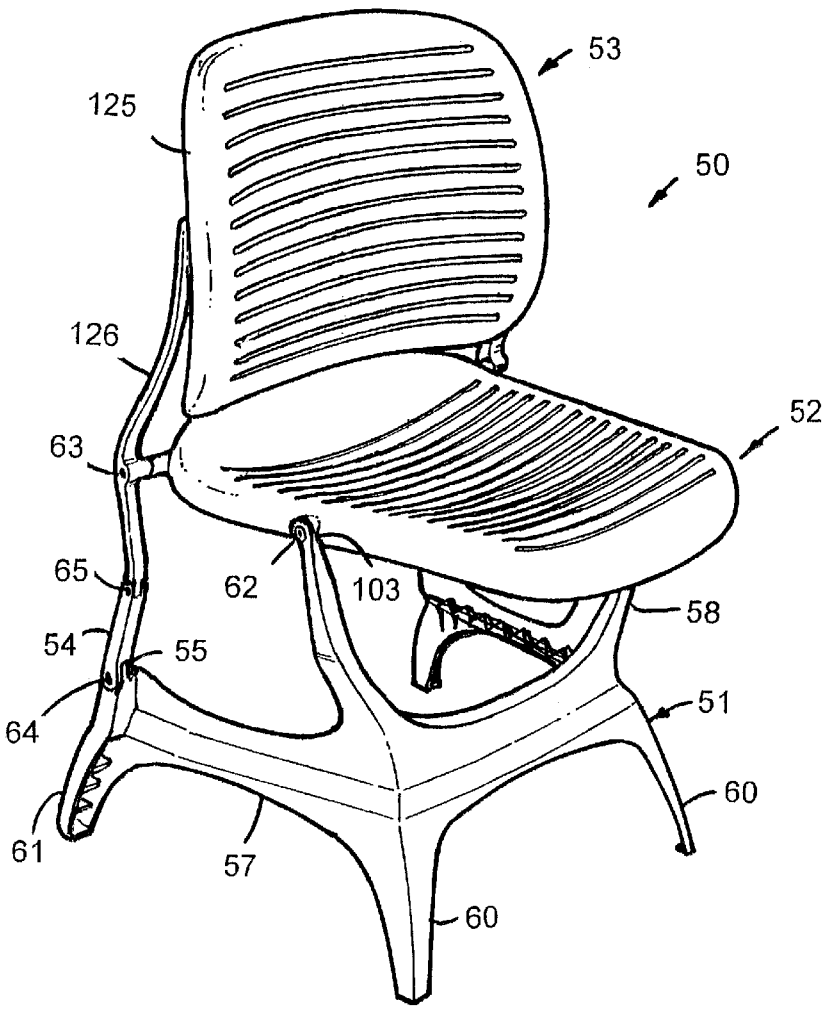
Figure 4:
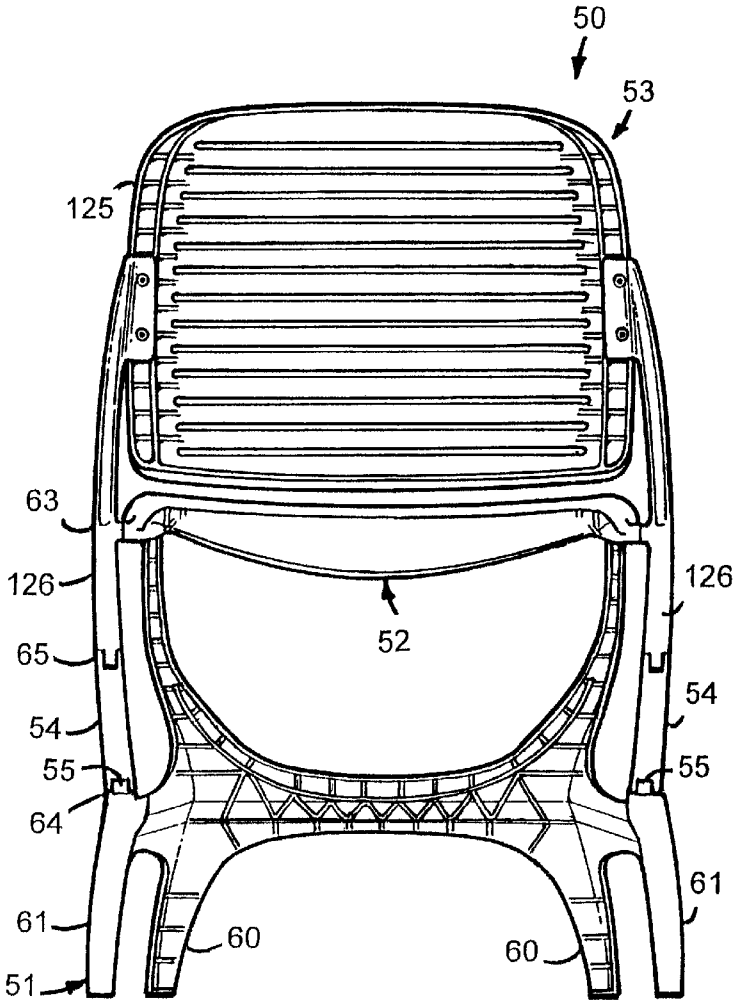
FIGS. 3–4A are front, rear, and top views of the chair shown in FIG. 1.
Figure 3:
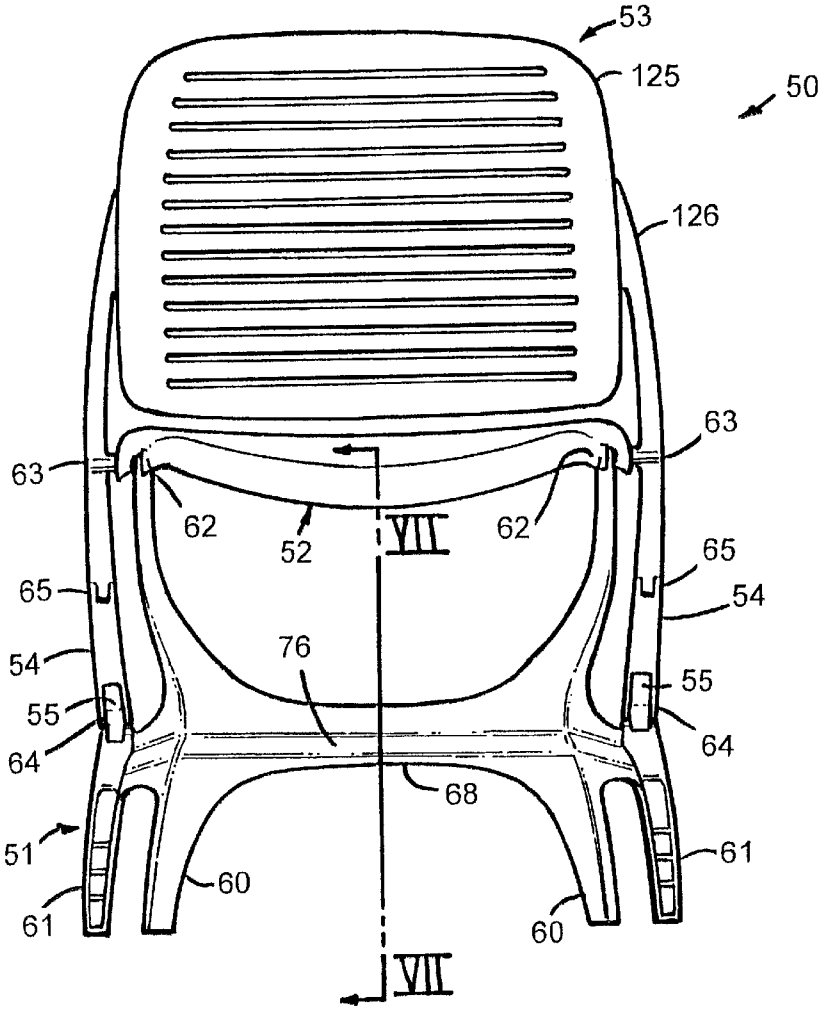
Figure 4A:
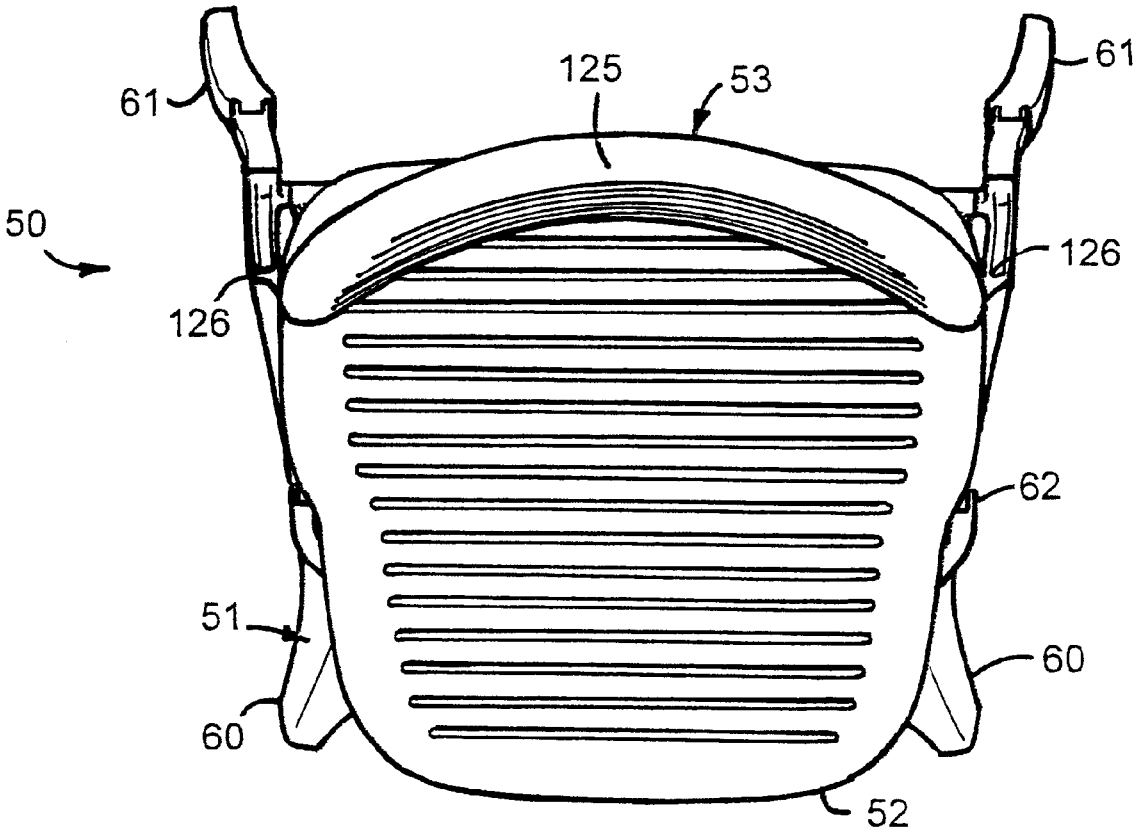
Figure 6:
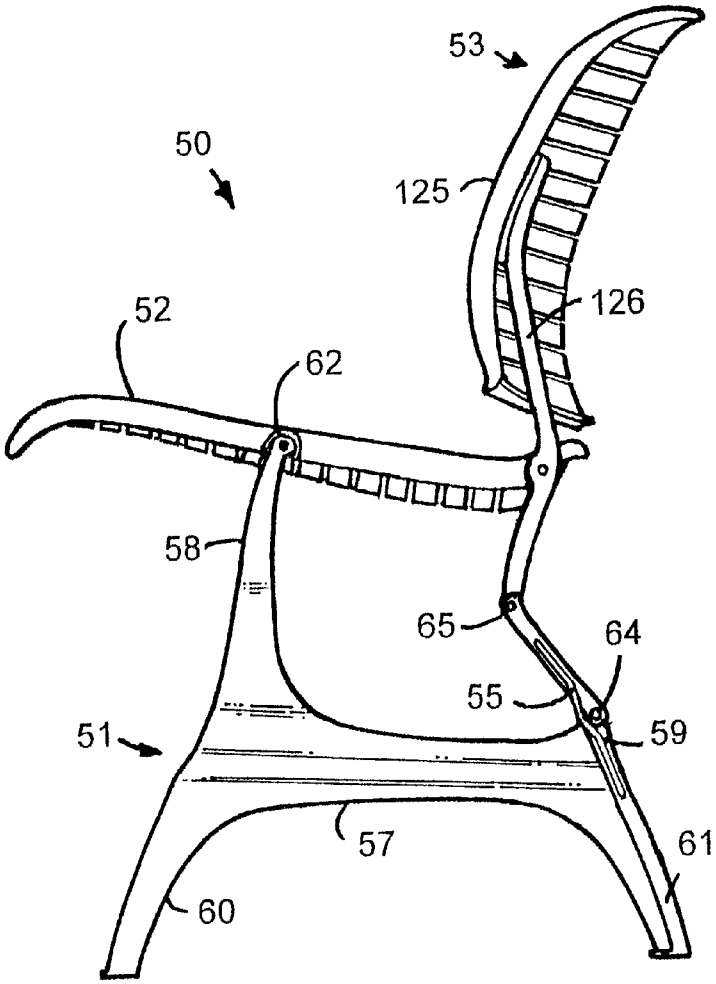
FIGS. 5 and 6 are side views of the chair shown in FIG. 1, FIG. 5 showing the back in an upright position and FIG. 6 showing the back in a reclined position.

It is noted that the outer surface of the base 51 is contoured and characteristically absent of ribs, such that it provides an attractive and smooth appearance (see FIGS. 1 and 2). Concurrently, the various ribs and webs extend inwardly so that they are generally hidden from view or in a location where they are not easily seen or noticed. Nonetheless, the base 51 is configured to be injection molded as a one-piece component using existing molding technology and apparatus. It will be apparent to those skilled in the art that the present base 51 can be strengthened by substituting different polymeric materials, and/or can be strengthened by increasing or varying the amount and types of reinforcing materials used. Further, it is to be understood that the base 51 can be strengthened by increasing wall thickness, the number and locations of ribs and webs, and by other ways in the art of molding polymeric components.

Figure 20:
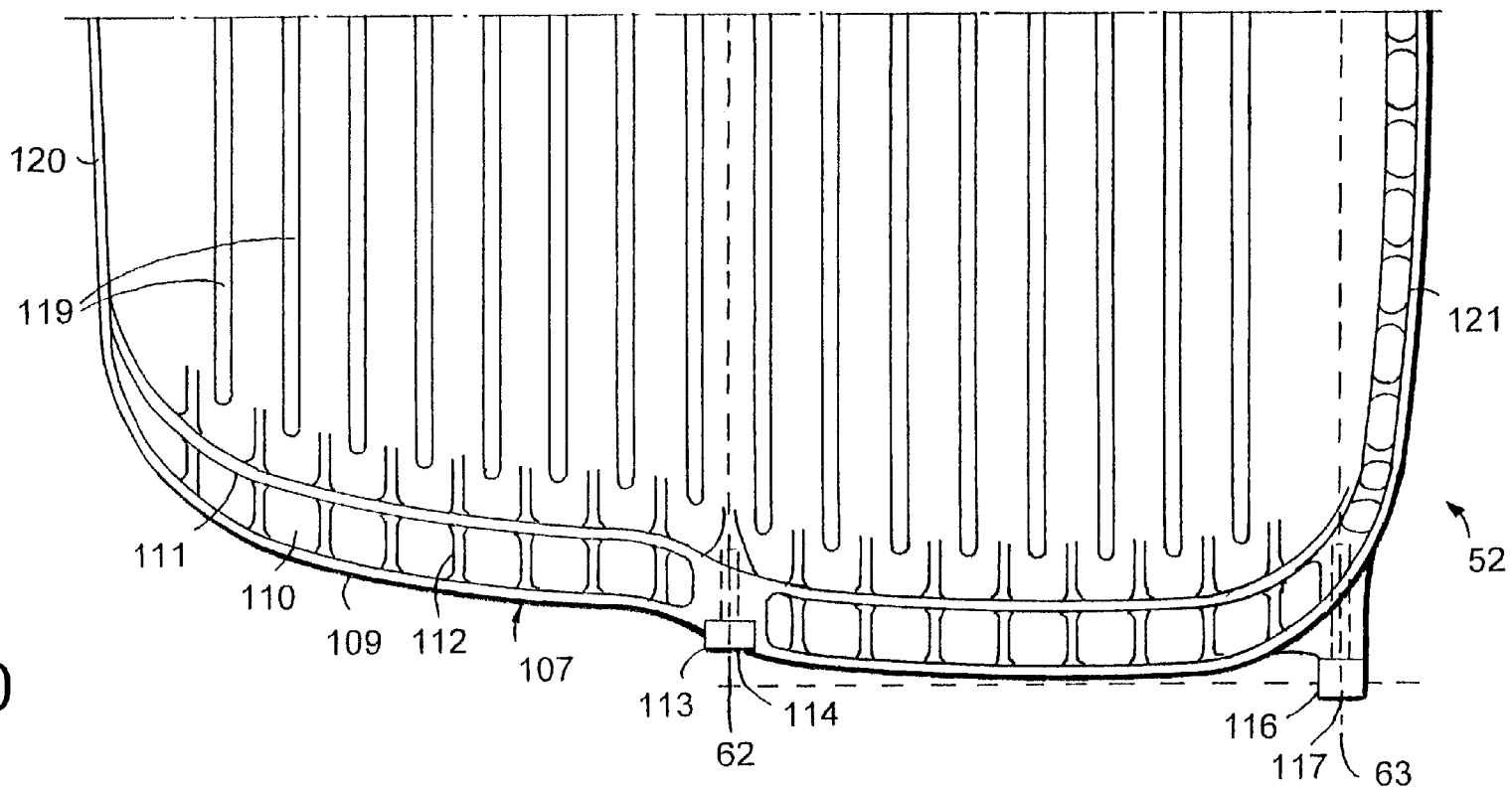
Figure 22A:
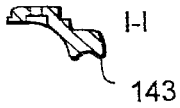
FIGS. 22A–22G are cross-sectional views taken along the lines II–TT, respectively, in FIG. 21.
Figure 22B:
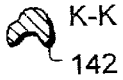
Figure 22C:
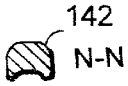
Figure 22D:
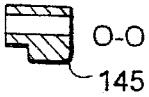
Figure 22E:
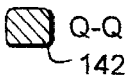
Figure 22F:
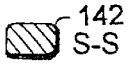
Figure 22G:
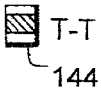

The seat 52 (FIGS. 17–20) is a one-piece molding that includes an integral seat frame 107 that extends around a perimeter of the seat 52, and a plurality of bands 108 that extend horizontally between opposing sides of the seat frame 107. The seat frame 107 has an inverted U-shaped cross section that extends around a perimeter of the seat 52. The inverted U-shaped cross section of seat frame 107 (FIG. 20) includes outer, top, and inner walls 109–111 with webs 112 spaced along the perimeter to stiffen the walls 109–111. A pair of enlargements 113 extends from the front up legs 58 of the base 51. The enlargements 113 are located midway along sides of the seat frame 107 and each include a hole 114 for receiving one of the pivot pins to form the seat-to-base pivot 62. A second pair of enlargements 116 is located at a rear of the seat 52 at a rear corner of the seat frame 107. These enlargements 116 include holes 117 for receiving another pivot pin to form the back-to-seat pivot 63. The bands 108 of seat 52 are separated by slots 119 that extend horizontally across the seat 52 between the inner walls 111. The spacing of the slots 119 and the thickness and shape of the bands 108 are chosen to provide an optimal resilient support to a seated user, while still maintaining the structure needed to stabilize the seat frame 107. A front section 120 of the seat frame 107 curves downwardly to comfortably support the knees and thighs of a seated user, while a rear section 121 of the seat frame 107 curves upwardly to comfortably matingly support buttocks of a seated user. In the illustrated seat frame 107, the inner wall 111 and the webs 112 continue around the sides and rear of the seat frame 107, but are discontinued across the front section 120 since the curvature of the front section 120 provides sufficient structure to the seat 52. It is contemplated that different rib arrangements and wall and rib arrangements are possible, and the scope of the present invention is believed to include the same.

Figure 16:
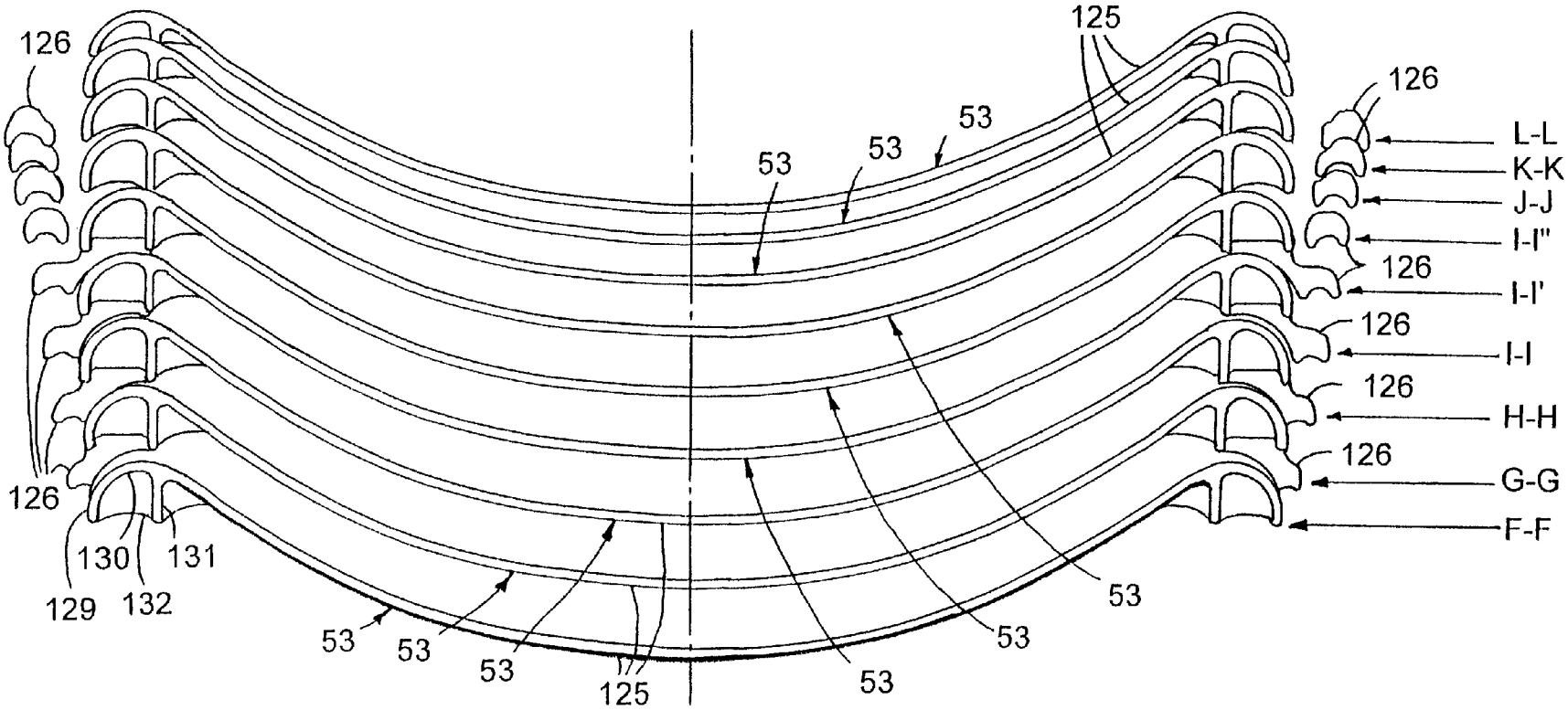
FIG. 16 is a horizontal cross section through nine chairs stacked together, with the location of the cross section in each successive stacked chair being shown by cross section lines FF–LL in FIG. 13.
Figure 17:
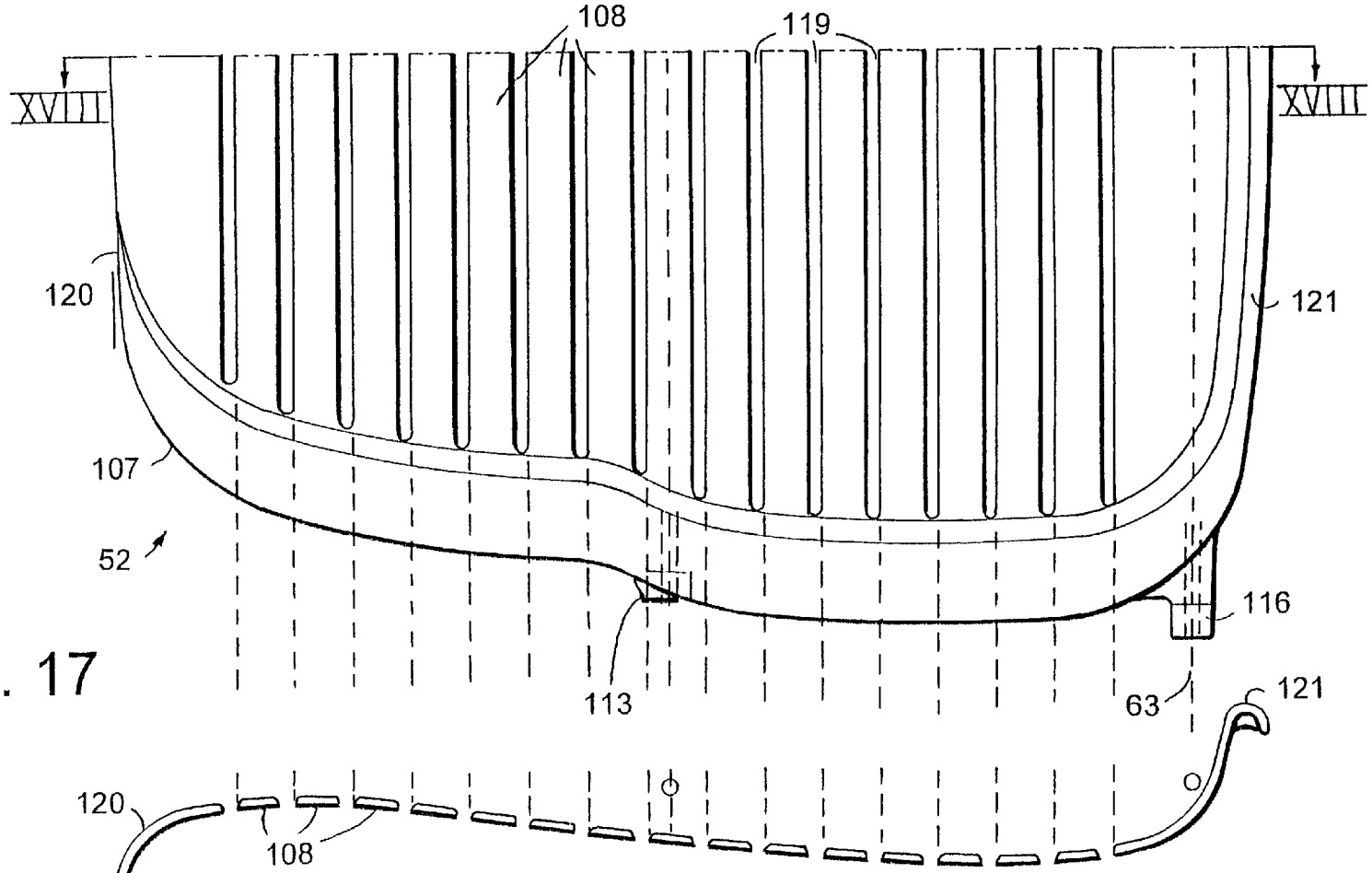
FIG. 17 is a plan view of half of the seat shown in FIG. 1.
Figure 18:
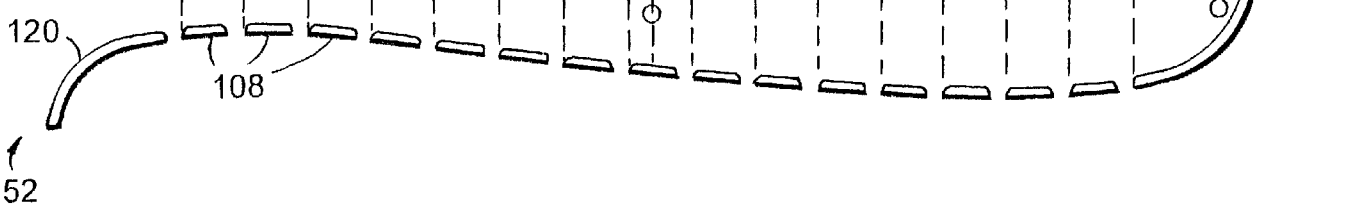
FIG. 18 a cross-sectional view taken along the line XVIII—XVIII in FIG. 17.
Figure 19:
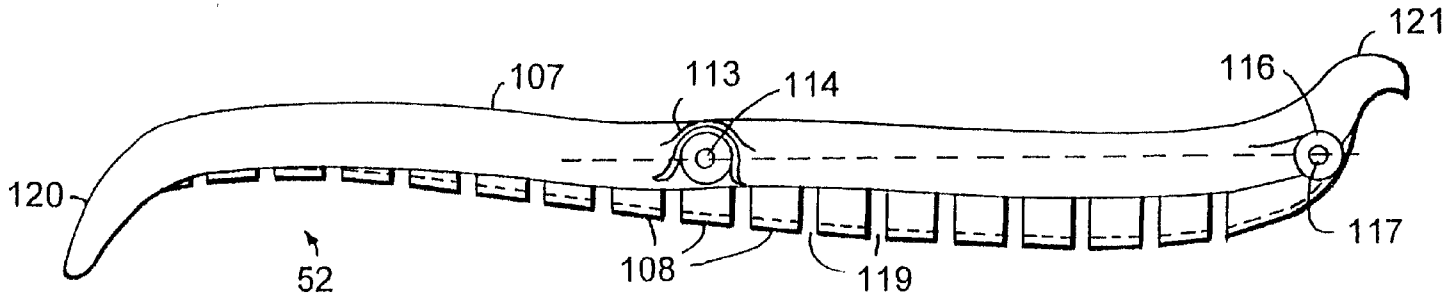
FIGS. 19 and 20 are side and bottom views of the seat shown in FIG. 17.

The back 53 (FIGS. 12–16) includes a back shell 125 and fixed levers 126 secured to the back shell 125. The back shell 125 is a one-piece molding that includes an integral back frame 127 that extends around a perimeter of the back shell 125, and a plurality of bands 128 that extend horizontally across sides of the back frame 127. The back frame 127 (FIG. 16) has an inverted U-shaped cross section that includes outer, top, and inner walls 129–131 with webs 132 spaced along the perimeter on its vertical sides to stiffen the walls 129–131. A pair of areas 133 located midway along the vertical sides of the back frame 127 each include a pair of holes for receiving screws 134 or other mechanical fasteners to fixedly attach the fixed levers 126 to the back shell 125. It is contemplated that other means can be used to attach the levers 126 to the back shell 125, such as adhesives, polymeric welding processes, and the like. The bands 128 are separated by slots 139 that extend horizontally across the back shell 125 between the inner walls 131. The spacing of the slots 139 and the thickness and shape of the bands 128 are chosen to provide an optimal resilient support to a seated user, while still maintaining the structure needed to stabilize the back frame 127. A top section 140 of the back frame 127 curves rearwardly to comfortably support the upper back and thoracic area of a seated user, while a lower section 141 of the back frame 127 also curves rearwardly to comfortably matingly support a lower back and lumbar area of a seated user. In the illustrated back frame 127, the inner wall 131 and the webs 132 continue vertically along the sides of the back frame 127, but are discontinued across the top and bottom of the back frame 127 since the curvature of the front section 140 provides sufficient structure to the back 53. It is contemplated that different rib arrangements and wall and rib arrangements are possible and that they will still be within a scope of the present invention.

Figure 21:
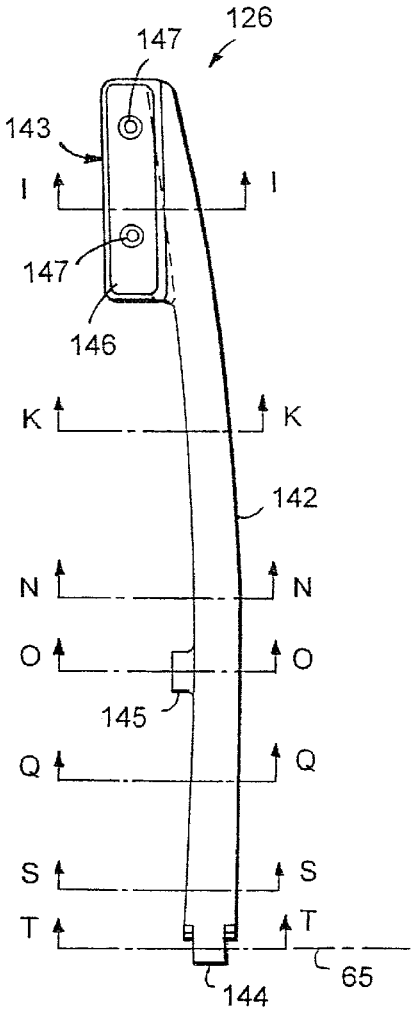
FIGS. 21 and 22 are front and side views of the fixed lever shown in FIGS. 4, 5, 15, and 16.
Figure 22:
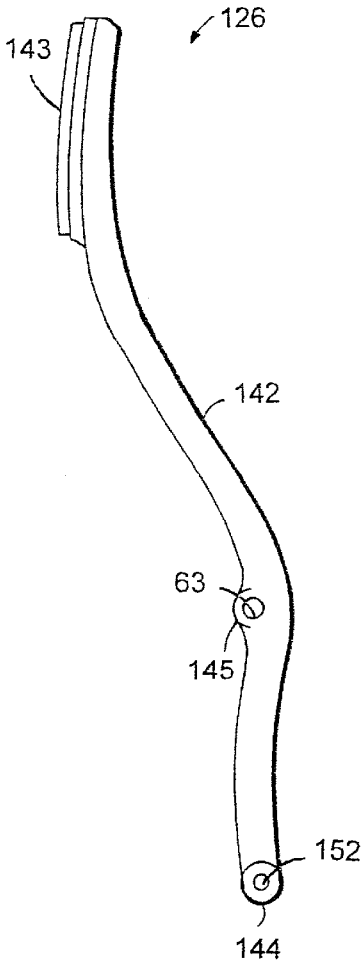
Figure 23A:
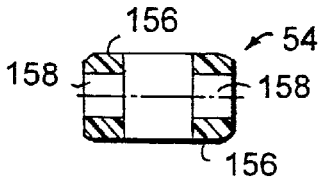
FIGS. 23A–23E are cross-sectional views taken along the lines TT–ZZ', respectively, in FIG. 24.
Figure 23B:
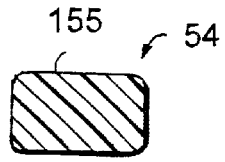
Figure 23C:
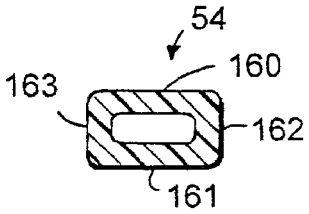
Figure 23D:
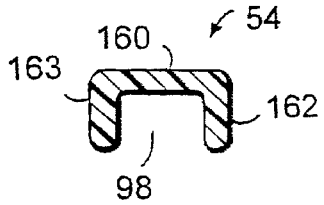
Figure 23E:
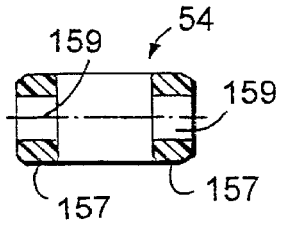
Figure 23:
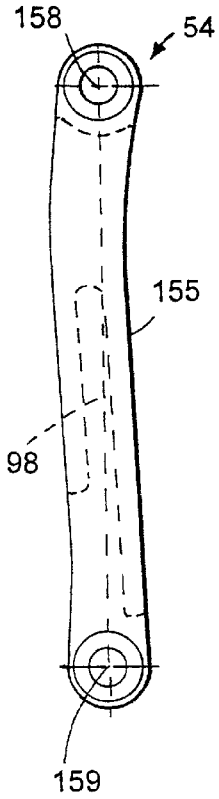
FIGS. 23 and 24 are side and front views of the link shown in FIG. 5.
Figure 24:
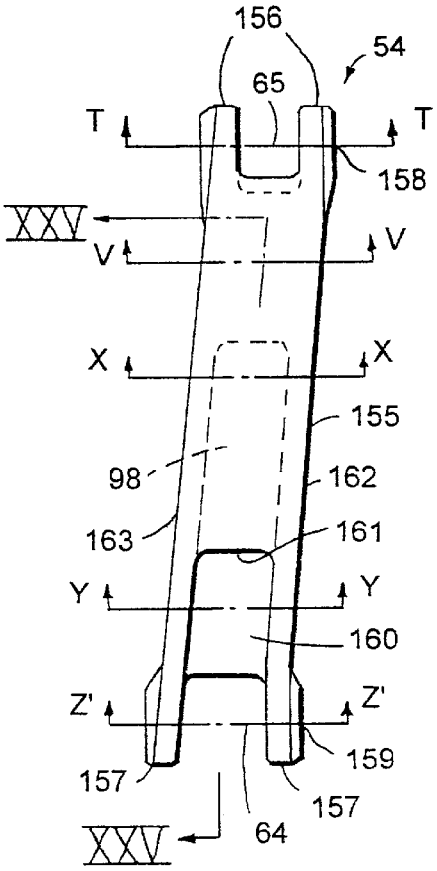

The levers 126 (FIGS. 21 and 22) are elongated one-piece molded components having an elongated body 142, with a back shell engaging top attachment section 143 at an upper end, a lower pivot-forming enlargement 144 at a bottom end, and an upper second pivot-forming enlargement 145 located in an intermediate position. The attachment section 143 includes a protruding face 146 shaped to be closely received between the outer and inner walls 129 and 131 and against the area 133 therebetween on the back frame 127. Holes 147 align with holes in the back frame 127, and screws 134 are extended through the holes 147 and are threadably secured by engagement of the screws into the attachment section 143 (see FIG. 16, section HH) or are secured in place by washers and nuts. The upper pivot-forming enlargement 145 includes a hole 150 for receiving a pivot pin 151 to form the back-to-seat pivot 63. The lower pivot-forming structure 144 includes a hole 152 for receiving a pivot pin 153 for forming the upper like-to-base pivot 65.

Figure 25:
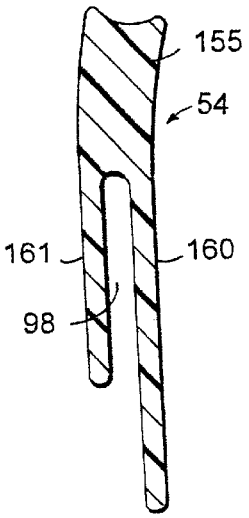
FIG. 25 is a fragmentary cross-sectional view taken along the line XXV—XXV in FIG. 24.
Figure 26:
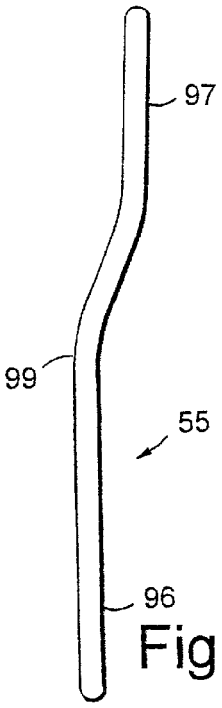
FIGS. 26 and 27 are side and front views of the spring shown in FIG. 5.
Figure 27:
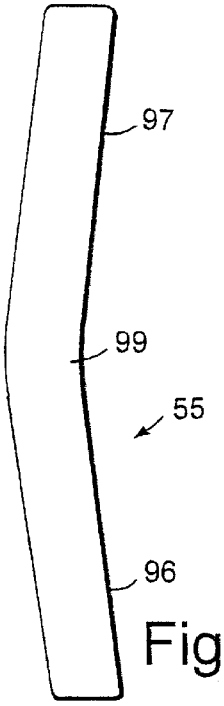

Each link 54 (FIGS. 23–28 and 23A–23E) includes a dog-bone-shaped body 155 having spaced top flanges 156 and spaced bottom flanges 157. The top flanges 156 are shaped to receive the bottom pivot-forming enlargement 144 on the lever 126. The top flanges 156 include aligned holes 158 that align with the hole 152 in lever 126 to receive a pivot pin. The bottom flanges 157 of link 54 are shaped to receive therebetween the top pivot-forming enlargement 59 of the base 51. Specifically, the bottom flanges 157 include aligned holes 159 that align with the hole 93 in the enlargement 59 to receive the pivot pin 94. The body 155 (FIG. 25) includes a center section with flanges 160 and 161 that define the pocket 98 for receiving the upper half 96 of the spring 55. Side flanges 162 and 163 capture the spring 55 and prevent the spring from slipping sideways out of the pocket 98. As noted previously, the pocket 98 allows the spring 55, which is a leaf spring, to be extended around the link-to-base pivot 65. Further, the pocket 98 retains and orients the leaf spring 55 in association with pocket 95 of the base 51 so that it will not accidentally slip out of or work its way out of the pocket 98, but the pocket 98 is further long enough to allow some slippage of spring 55 as the back 53 is reclined, due to the offset position of spring 55 relative to the axis 64. Optimally, the link 54 is selected to position axes 63 to 65 and axes 65 to 64 about the same distance apart. This provides a good synchronous motion by the seat 52 and back 53 upon recline.

Figure 5:
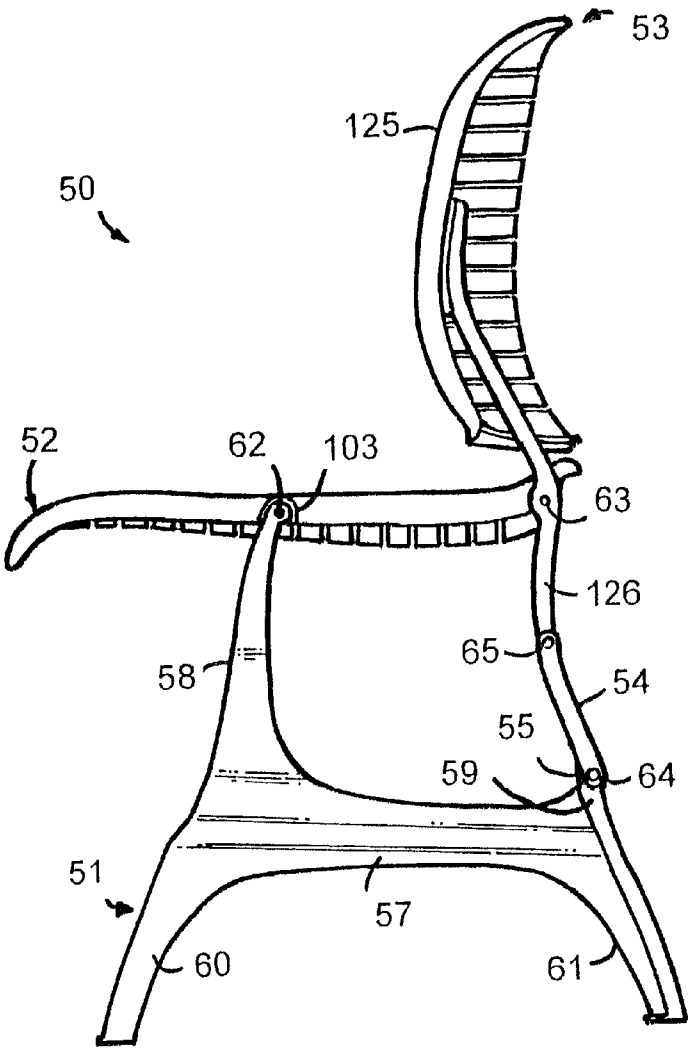

The shape and spring constant of the spring 55 will vary depending upon the application, the design criteria, and its relation to the pivot at which it is used. It is contemplated that the spring 55 can be located at any one of the pivots 62–65, and that a scope of the present invention includes different springs other than only leaf springs. The upward orientation of the spring 55 (see FIG. 5) significantly adds to the stability of the chair 50 in its rest position or upright position, and also reduces the need for a very strong spring 55. It is contemplated that in the present chair 50, the spring 55 will only need to have a surprisingly low spring constant, and will be made from a section of glass reinforced polyester material having a thickness of about 0.200 inches.

The orientation and shape of the present components and the distance between pivots 62–65 lead to a particularly functional and comfortable chair 20. The specific dimensions of the preferred chair 20 are provided to be very clear about their relationships, but it is noted that the ratios and relationships can be changed to achieve desired changes in function, comfort, or appearance of a chair. The illustrated dimensions (FIG. 6A) are as follows: D1=5.0 inches; D2=5.0 inches; D3=4.8 inches; D4=9.0 inches; D5=10.4 inches; D6=9.8 inches; D7=9.0 inches; angle A1=90 degrees; and angle A2=73.3 degrees. These dimensions and relationships result in what I call a "meta-stable" behavior, which provides an almost perfect counter balancing effect. This enables the sitter to spontaneously control the pitch of the chair (seat and back) as well as actually rock in the chair. This rocking ability is considered an important ergonomic benefit since rocking actually stimulates circulation in the body and exercises the muscles.

The unique behavior of this chair is attributable to the geometry of its linkage and the springs. The synchronous relationship between the seat and the back is an important aspect of this meta-stable behavior, as are the specific locations of the various pivot points which define the geometry. The drawing of FIG. 6A shows the chair in an unloaded position. You will note that link 54 (which I call the pivot link) has a forward slope of 73.3 degrees (or about 16.7 degrees from vertical). This locates pivot 65 "over center" relative to pivot 64. This, of course, means that when loaded, pivot 65 will rotate towards the front of the chair. The "over center" horizontal displacement in unloaded position between pivots 65 and 64 is about 1.4 inches. Note that pivot 63 is vertically positioned over pivot 65.

Figure 29:
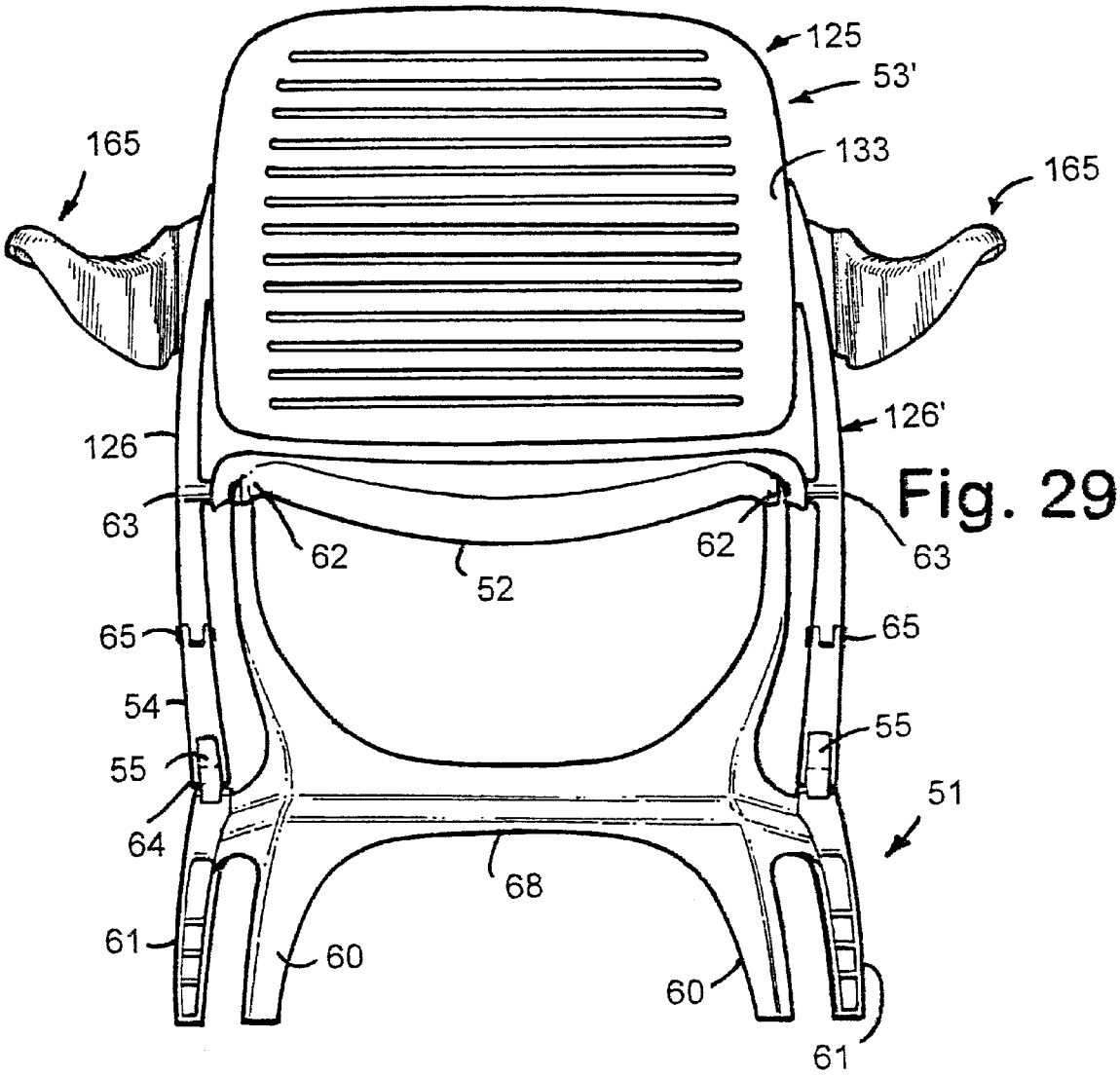
FIGS. 29 and 30 are front and side views of a chair similar to the chair shown in FIGS. 3 and 5, but including armrests.
Figure 31:
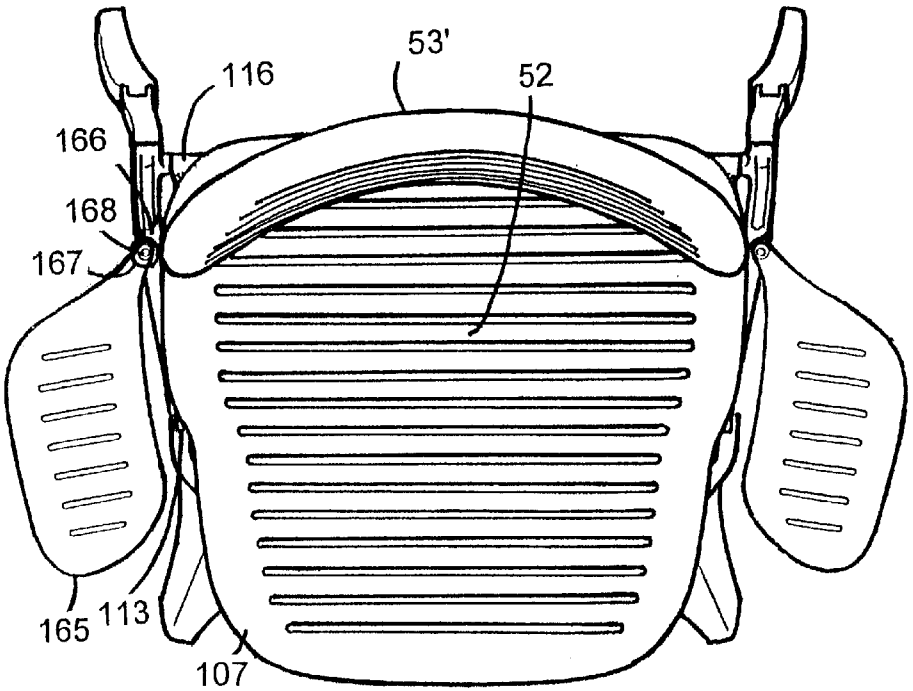
FIG. 31 is a top fragmentary view of the chair shown in FIG. 30, with rotated positions of the armrests being shown in phantom.
Figure 30:
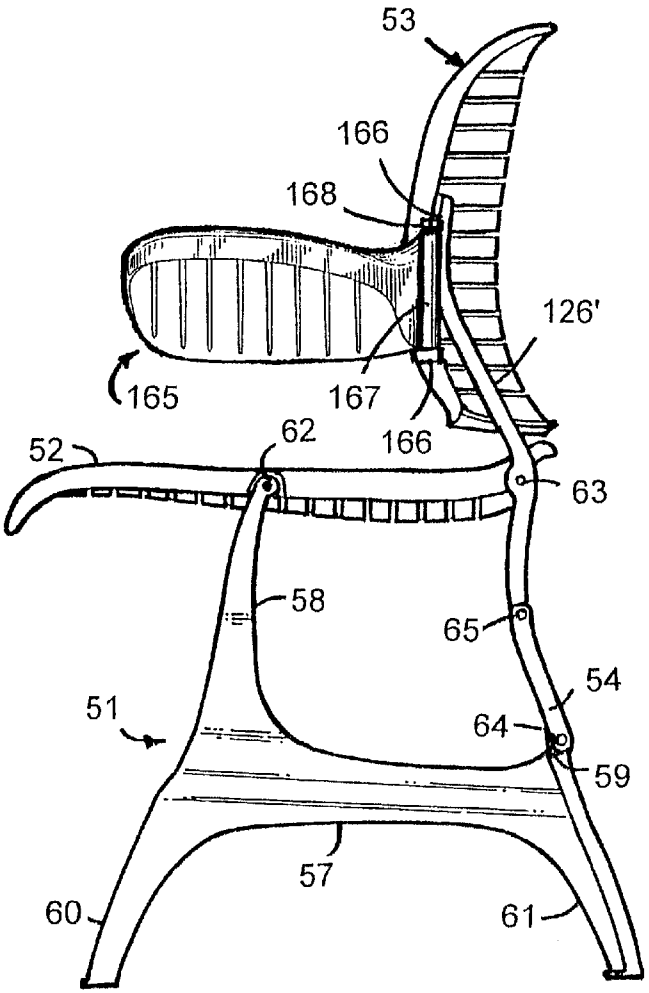
Figure 32:
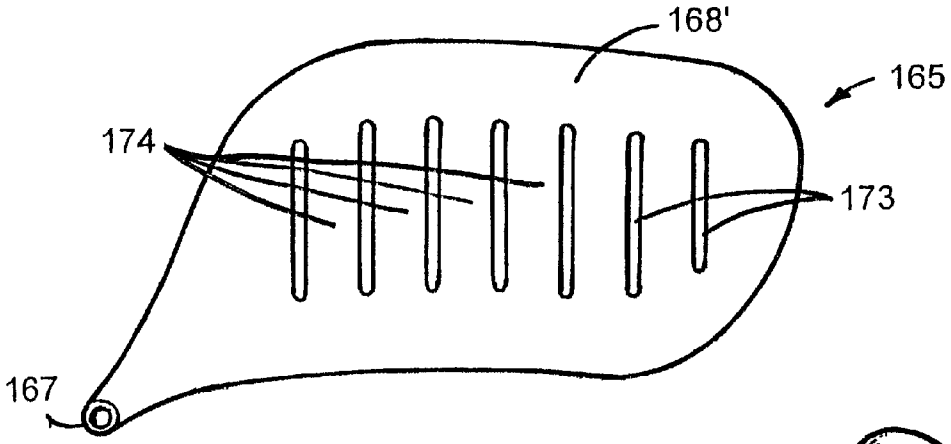
FIGS. 32–34 are top, side, and front views of the armrest shown in FIG. 29.
Figure 34:
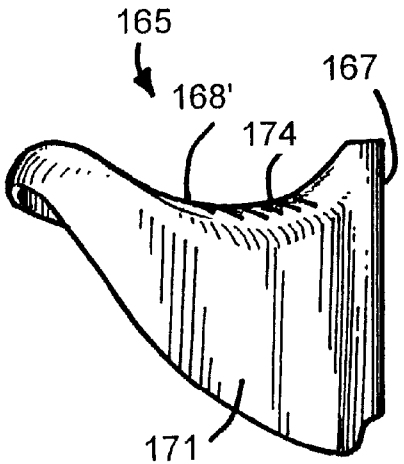
Figure 33:
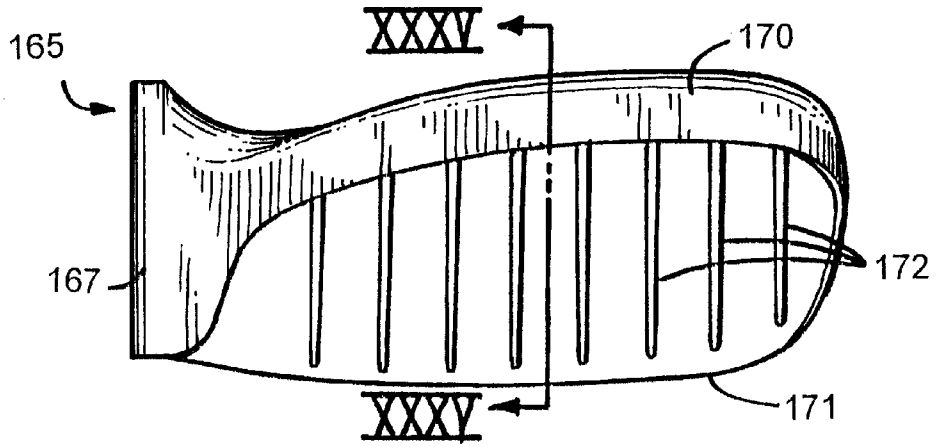
Figure 35:
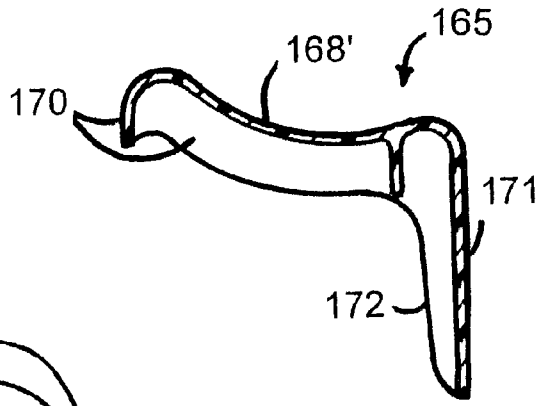
FIG. 35 is a cross-sectional view taken along the line XXXV—XXXV in FIG. 33.
Figure 36:
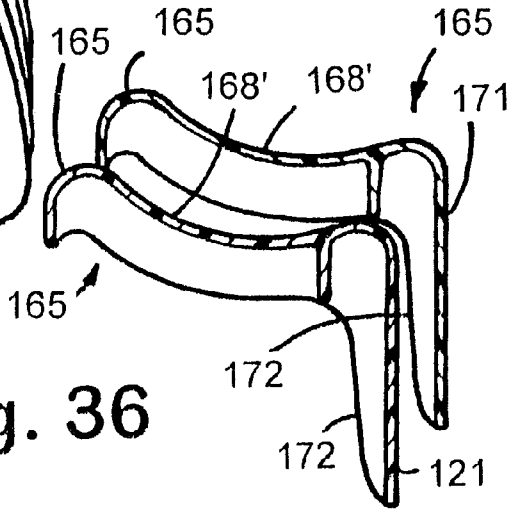
FIG. 36 is a side view similar to FIG. 35, but showing a pair of the armrests on a stacked arrangement of the chairs shown in FIG. 37.
Figure 37:
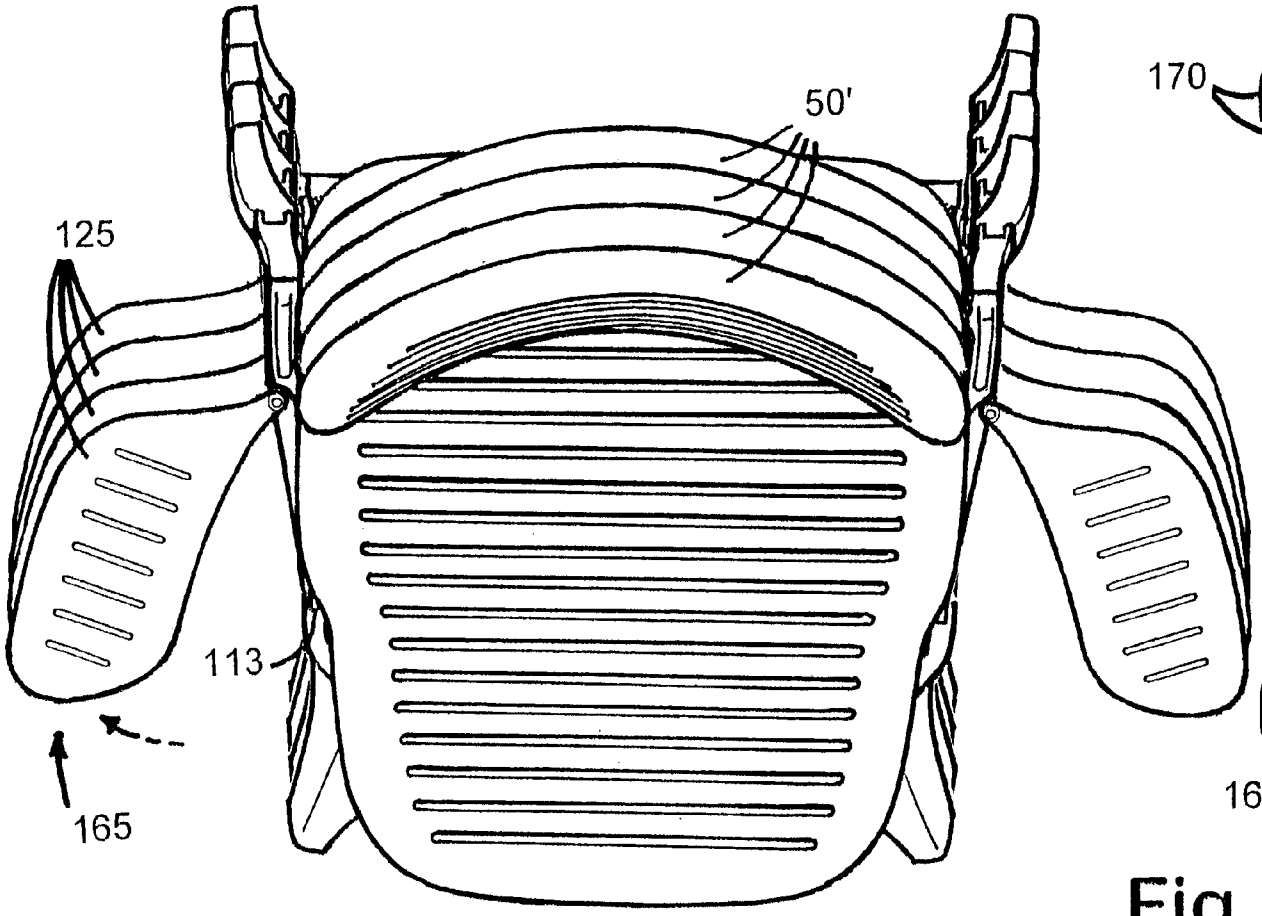
FIG. 37 is a top view of a plurality of seven stacked chairs including the armrests mateably engaging.

In one form of the present invention, armrests 165 (FIG. 29) are attached to a chair 50' similar to chair 50, but having modified levers 125' configured to support armrests 165. In the illustrated embodiment, armrests 165 are pivoted to the lever 126' adjacent the top attachment area 133 of the back 53' for pivotal movement about a vertical axis. Specifically, the top attachment section 133 includes outwardly extending apertured bosses 166 (FIGS. 30 and 31), and the armrests 165 include apertured flanges 167 connected to the apertured bosses 166 by a vertical pivot pin 168. (It is contemplated that the pivot pins 168 could be incorporated into the flanges 167, and even configured for snap attachment between the bosses 166, if desired.) The apertured bosses 166 and flanges 167 are configured to hold the armrests 165 in a selected position, but it is contemplated that they could be designed to move the armrests 165 naturally by gravity toward an inward position. The armrests 165 each have a horizontally extending armrest body panel 168' (FIG. 32) configured to comfortably support a seated user's forearm, and further include a perimeter stiffening flange 170 that extends around the armrest body 168' to reinforce the armrest body panel 168'. An inner portion 171 of the stiffening flange 170 is extended vertically a significant distance so that there is sufficient structure to adequately support the apertured flanges 167, and vertical webs 172 are also added to stiffen armrest body panel 168'. It is contemplated that top and bottom flanges 167 can be used, or an enlargement having a vertical hole can be used on a rear of the armrest 165 to support the pivot pin 168. Slots 173 are formed in the armrest panel 168 to define flexible bands 174. The bands 174 comfortably support a seated user's forearm, but also allow air to circulate about the seated user's forearm. The armrests 165 are configured to mateably engage (see FIG. 36) when the chairs 50' are stacked (see FIG. 37). Also, the slots 173 and webs 172 match the aesthetics of the slots in the seat 52 and back 53, adding to the attractive appearance of the chair 50.

It is contemplated that the present construction includes a distinctive appearance that is inventive and that the armrests compliment such distinctiveness.

However, it is important to note that the chair arm 165 (FIGS. 29–31), like the seat and back, provides a sophisticated ergonomic solution in which a three-dimensional doubly curved form is developed that is anatomically friendly. In other words, the arm 165 has a shape optimized from an ergonomic (comfort and health) perspective. The arm 165 has a pronounced concave shape in transverse section and a very light concave shape in longitudinal section. In plan view, the arm 165 has an inwardly arcuate shape.

In addition to its shape, the arm 165 is designed to rotate along a nominally vertical axis of pivot pins 168. This rotation will have a very slight preload through a spring or helical screw medium. It is designed to afford the person using the arm 165 the opportunity to move the arm 165 spontaneously in a lateral (rotational) direction. This is philosophically analogous to the articulating action of the chair 50 itself. The goal is to provide an arm 165 that is ergonomically refined and one in which the orientation of the arm(s) 165 will spontaneously adapt to user preference. Further, another function of the rotation of arm 165 is to accommodate the lateral stacking. These arms 165 will automatically rotate out of the way to make room as additional chairs are added to the stack.

The arm 165 is preferably injection molded from the same high-performance thermoplastic as the seat 52 and back 53. Like the seat 52 and back 53, the arm 165 is slotted to provide air circulation for naturally cooling, and like the seat 52 and back 53, the arm 165 would not be upholstered (albeit that it could be upholstered if desired). Again, like the seat 52 and back 53, the goal is to provide a high level of ergonomic performance and comfort without the reliance on padding and upholstery. Also, the chair arm 165 represents a zone of high vulnerability to wear and soiling. The highly durable surface of this polymer arm 165 results in a surface of very long life and low maintenance. Again, the goal of minimizing weight is sustained by this arm design.

When a seated user initially sets in the chair 50 (FIG. 5), the forward location of the seat-to-base pivot 62 and also the vertical arrangement of pivots 63–65 cause the chair 50 to provide a relatively firm and stable-feeling chair construction. When the seated user initially leans rearwardly, the back 53 pivots about the seat-to-back pivot 63, causing the link 54 to move from its upwardly extending "at rest" or upright position and to pivot forwardly against the bias of spring 55. The rate of recline of the back 53 is initially significantly faster that that of the seat 52, but it is noted that the specific ratio of angular rotation of the back 53 to the seat 52 varies during recline. As the seated user reclines an additional amount, a small angular rotation of the back 53 results in a significant angular rotation of the link 54, and in turn a significant bending of the spring 55, thus providing increasing support for a user as they lean rearwardly. At an extreme rearward position of maximum recline, the back 53 is about perpendicular to the link 54. In this "fully reclined" position, any attempt to further recline the back 53 will result in forces that extend longitudinally through the link 54 and through the pivots 64 and 65. Thus, any additional force to pivot the back 53 rearwardly does not result in any additional rearward rotation of the back 53. By this arrangement, the links 54 naturally limit recline of the back 53.

Chairs 50 (FIG. 11) are configured for high density storage. For convenience, the operation of nesting the chairs 50 together is described as if a first one of the chairs 50 is rested on a floor. However, it should be clear that a wheeled cart having an angled support surface or holder can be used so that the chairs are stored at any angle relative to a building floor that is desired. Notably, the angle supporting the nested chair affects their storage density, but also affects the height that the chairs must be lifted in order to nest the chairs.

To store the chairs, a "non-stacked" chair 50 is slid primarily horizontally onto the previously stored mating chair along a stacking direction "A" (FIG. 11 into a nested arrangement with the protruding portion of the base 51, including the front beam section 68, being moved into the open structure or throat of the "previously stored" chair 50. As the "non-stacked" chair 50 engages the previously stacked chair, the horizontal rib 70 of the side beam sections 67 of the "non-stacked" chair 50 engages the outer surface of the angled mid portion 74 of the previously stored mating chair 50, facilitating their nested engagement (see FIG. 7M). The "non-stacked" chair 50 is slid into engagement with the previously stacked chair 50 until the front beam section 68 of one chair 50 engages the front beam section 68 of the other chair 50. When the chairs 50 are fully nested, the seats 52 and backs 53 of the two chairs are relatively close together and adjacent each other. The illustrated chairs 50 can be engaged to a nested stacking density of one chair in less than two inches along the stacking direction, although it is contemplated that stacking densities of one chair every three or so inches will also provide excellent benefits to a using entity. Specifically, the present chairs stack to a density of 1.3 inches horizontal and 0.95 inches vertical. The total weight of the illustrated chair 50 can be made as low as 10 pounds, such that the chairs 50 can be easily lifted and stacking is easily accomplished, particularly in view of the track-assisted horizontal engagement and the lightweight of the chairs.

In the foregoing description, it will be readily appreciated by persons skilled in the art that modifications may be made to the invention without departing from the concepts disclosed herein. For example, it is specifically contemplated that the present concepts can be incorporated into a pedestal chair or a bench-type chair. Such modifications are to be considered as included in the following claims, unless these claims by their language expressly state otherwise.

The invention claimed is:

1. A chair comprising:

a base;

a seat pivoted to the base;

a back pivoted to the seat;

an upwardly extending link pivoted to a rear of the base at a lower pivot and to a bottom of the back at an upper pivot; the base, the seat, the back, and the link defining a linkage arrangement where, when the back is reclined at a first angular rate, the seat rotates at a second angular rate in synchronous motion with the back; and an energy device operably connected to the linkage arrangement and biasing the back toward an upright position.

2. The chair defined in claim 1, wherein at least one of the seat and the back include a perimeter with edge-adjacent frame sections that define an open area that extends completely around the perimeter and that stiffen the perimeter.

3. A chair comprising:

a base;

a seat pivoted to the base;

a back pivoted to the seat;

an upwardly extending link pivoted to a rear of the base at a lower pivot and to a bottom of the back at an upper pivot; the base, the seat, the back, and the link defining a linkage arrangement where, when the back is reclined at a first angular rate, the seat rotates at a second angular rate in synchronous motion with the back; and an energy device operably connected to the linkage arrangement and biasing the back toward an upright position, the energy device comprising a leaf spring that spans at least one of the upper and lower pivots.

4. The chair defined in claim 3, wherein the base and the link include opposing pockets for receiving ends of the leaf spring.

5. The chair defined in claim 4, wherein the leaf spring is bent to a non-linear shape to extend around the one pivot as the spring extends between the opposing pockets.

6. The chair defined in claim 4, wherein the opposing pockets include surfaces forming a closed cross section for capturing ends of the leaf spring.

7. The chair defined in claim 3, wherein at least one of the seat and the back include a perimeter with edge-adjacent frame sections that define an open area that extends completely around the perimeter and that stiffen the perimeter.

8. A chair comprising:

a base;

a seat pivoted to the base;

a back pivoted to the seat;

an upwardly extending link pivoted to a rear of the base at a lower pivot and to a bottom of the back at an upper pivot; the base, the seat, the back, and the link defining a linkage arrangement where, when the back is reclined at a first angular rate, the seat rotates at a second angular rate in synchronous motion with the back; and an energy device operably connected to the linkage arrangement and biasing the back toward an upright position: and wherein the back is pivoted to the seat at a back-to-seat pivot, and wherein the back-to-seat pivot is located generally above the upper and lower pivots of the link.

9. The chair defined in claim 8, including a molded armrest pivotally attached to the back.

10. The chair defined in claim 8, wherein the base, the seat, the back, and the link have a total weight of less than about 10 pounds.

11. The chair defined in claim 8, wherein the link is configured to rotate to a position where the link prevents further recline of the back.

12. The chair defined in claim 8, wherein the base, the back, and the seat are configured to nest into an arrangement that reduces the space occupied by the chair by at least 50 percent.

13. A chair comprising:

a base;

a seat pivoted to the base;

a back pivoted to the seat;

an upwardly extending link pivoted to a rear of the base at a lower pivot and to a bottom of the back at an upper pivot; the base, the seat, the back, and the link defining a linkage arrangement where, when the back is reclined at a first angular rate, the seat rotates at a second angular rate in synchronous motion with the back; and an energy device operably connected to the linkage arrangement and biasing the back toward an upright position; and wherein the back includes a back shell and a fixed lever secured to the back shell that extends downwardly into pivotal engagement with the link.

14. The chair defined in claim 13, including a molded armrest pivotally attached to the back.

15. The chair defined in claim 13, wherein the base, the seat, the back, and the link have a total weight of less than about 10 pounds.

16. The chair defined in claim 13, wherein the link is configured to rotate to a position where the link prevents further recline of the back.

17. The chair defined in claim 13, wherein the base, the back, and the seat are configured to nest into an arrangement that reduces the space occupied by the chair by at least 50 percent.

18. The chair defined in claim 13, wherein at least one of the seat and the back include a perimeter with edge-adjacent frame sections that define an open area that extends completely around the perimeter and that stiffen the perimeter.

19. A chair comprising:

a base;

a seat pivoted to the base;

a back pivoted to the seat;

an upwardly extending link pivoted to a rear of the base at a lower pivot and to a bottom of the back at an upper pivot; the base, the seat, the back, and the link defining a linkage arrangement where, when the back is reclined at a first angular rate, the seat rotates at a second angular rate in synchronous motion with the back; and an energy device operably connected to the linkage arrangement and biasing the back toward an upright position; and wherein the back is pivoted to the seat at a seat-to-back pivot, and wherein a distance between the seat-to-back pivot and the upper pivot is about equal to a dimension between the upper and lower pivots.

20. A chair comprising:

a base comprising a one-piece molded component;

a seat pivoted to the base;

a back pivoted to the seat;

an upwardly extending link pivoted to a rear of the base at a lower pivot and to a bottom of the back at an upper pivot; the base, the seat, the back, and the link defining a linkage arrangement where, when the back is reclined at a first angular rate, the seat rotates at a second angular rate in synchronous motion with the back; and an energy device operably connected to the linkage arrangement and biasing the back toward an upright position.

21. The chair defined in claim 20, wherein the back includes a back shell comprising a one-piece molding.

22. The chair defined in claims 21, wherein the back shell includes an integral back frame having a perimeter with a C-shaped cross section, and further including strips that extend across and interconnect opposing side sections of the seat frame.

23. The chair defined in claim 21, wherein the seat comprises a one-piece molding having an integral seat frame that extends around a perimeter of the seat, the perimeter including sections having a C-shaped transverse cross section.

24. The chair defined in claim 20, including a molded armrest pivotally attached to the back.

25. The chair defined in claim 20, wherein the base, the seat, the back, and the link have a total weight of less than about 10 pounds.

26. The chair defined in claim 20, wherein the link is configured to rotate to a position where the link prevents further recline of the back.

27. The chair defined in claim 20, wherein the base, the back, and the seat are configured to nest into an arrangement that reduces the space occupied by the chair by at least 50 percent.

28. The chair defined in claim 20, wherein at least one of the seat and the back include a perimeter with edge-adjacent frame sections that define an open area that extends completely around the perimeter and that stiffen the perimeter.

29. A chair comprising:

a base;

a seated pivoted to the base;

a back pivoted to the seat at the back pivot for movement between upright and reclined positions;

a link pivoted to the base at a first pivot and to the back at a second pivot to form an interconnected linkage arrangement, the back pivot being located above the first and second pivots; and an energy device located at and operably connected to the link and at least one of the first and second pivots, and configured to bias the back toward the upright position.

30. The chair defined in claim 29, wherein the energy device comprises a leaf spring.

31. The chair defined in claim 30, wherein the base, the seat, and the back define a nestable structure and further define an open structure for receiving the nestable structure.

32. The chair defined in claim 29, including a molded armrest pivotally attached to the back.

33. The chair defined in claim 29, wherein the base, the seat, the back, and the link have a total weight of less than about 10 pounds.

34. The chair defined in claim 29, wherein the link is configured to rotate to a position where the link prevents farther recline of the back.

35. The chair defined in claim 29, wherein the base, the back, and the seat are configured to nest into an arrangement that reduces the space occupied by the chair by at least 50 percent.

36. The chair defined in claim 29, wherein at least one of the seat and the back include a perimeter with edge-adjacent frame sections that define an open area that extends completely around the perimeter and that stiffen the perimeter.

37. A chair comprising:

a base having a horizontal U-shaped structure defining front and rear corners, and further having a down leg extending downwardly from each of the front and rear corners and an up leg extending upwardly from each of the front corners;

a link extending from each of the rear corners; and a seat and a back operably supported on the up legs and the links for movement between upright and reclined positions.

38. The chair defined in claim 37, wherein the U-shaped structure of the base opens rearwardly and is configured to permit nesting of the base, the seat, and the back against an identical chair.

39. The chair defined in claim 37, including a molded armrest pivotally attached to the back.

40. The chair defined in claim 37, wherein the base, the seat, the back, and the link have a total weight of less than about 10 pounds.

41. The chair defined in claim 37, wherein the link is configured to rotate to a position where the link prevents further recline of the back.

42. The chair defined in claim 37, wherein the base, the back, and the seat are configured to nest into an arrangement that reduces the space occupied by the chair by at least 50 percent.

43. The chair defined in claim 37, wherein at least one of the seat and the back include a perimeter with edge-adjacent frame sections that define an open area that extends completely around the perimeter and that stiffen the perimeter.

44. An article of furniture comprising:

first and second furniture components pivoted together at a joint defining an axis of rotation, the first and second furniture components including first and second recesses, respectively, extending from the joint; and a leaf spring having first and second ends that extend into the first and second recesses and having a section offset from and extending around the axis of rotation, the leaf spring biasing the first and second furniture components in a first direction.

45. The article defined in claim 44, wherein the joint includes a pivot pin defining the axis.

46. A chair comprising:

a molded one-piece base;

a molded one-piece seat pivoted to the base;

a reclineable back pivoted to the seat and also operably mounted on the one-piece base, the back being movable between upright and reclined positions; and a spring integrally attached to at least two of the base, the back, and the seat and biasing the back toward the upright position.

47. A chair comprising:

a chair frame having a horizontally extending mid-frame section with four corners and having up legs and down legs extending from each of the corners of the mid-frame section, with the down legs being adapted to stably support the chair frame on a floor surface; and a back and a seat operably connected to the up legs of the mid-frame and configured to move with a synchronous motion upon recline of the back.

48. The chair defined in claim 47, wherein a total weight of the mid-frame, the back, and the seat is less than about 10 pounds.

49. The chair defined in claim 48, including armrests pivotally attached to the back and biased to return to a first position.

50. A chair comprising:

a molded polymeric base including down legs configured to stably engage a floor surface and including sections forming a rail support;

a seat and a reclineable back operably connected to the base for synchronous movement during recline of the back; and the base defining an opening in one direction and having a shape configured to mateably nestingly engage a corresponding opening on an identical chair parallel the one direction, the base, the seat, and the back being configured to mateably nestingly engage the identical chair with the rail support being adapted to support a weight of the identical chair, whereby the chair can be stored in the dense stacked arrangements with other identical chairs.

51. The chair defined in claim 50, wherein the base, the seat, and the back are engageable to form a nested stack of chairs having a density that results in at least a 50 percent reduction in storage space required to store the chairs.

52. The chair defined in claim 50, wherein the base, the seat, and the back are configured to provide a stack density that is at most about 1.3 inches in a first direction and about 0.95 inches in a perpendicular second direction.

* * * * *